US007551152B2

(12) United States Patent
Nakamura et al.

(10) Patent No.: US 7,551,152 B2
(45) Date of Patent: Jun. 23, 2009

(54) DISPLAY AND METHOD OF DRIVING PIXEL

(75) Inventors: Kazuo Nakamura, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 628 days.

(21) Appl. No.: 11/345,453

(22) Filed: Feb. 1, 2006

(65) Prior Publication Data

US 2006/0170636 A1 Aug. 3, 2006

(30) Foreign Application Priority Data

Feb. 3, 2005 (JP) ..... 2005-028020

(51) Int. Cl.
*G09G 3/30* (2006.01)

(52) U.S. Cl. ..... 345/76; 345/77; 345/87; 345/92

(58) Field of Classification Search ..... 345/36, 345/38–39, 45, 76–78, 82–84, 87–88, 90–95, 345/98–100, 204–205, 210–214; 315/169.1, 315/169.3; 340/815.45
See application file for complete search history.

(56) References Cited

U.S. PATENT DOCUMENTS

| | | | | |
|---|---|---|---|---|
| 5,079,483 | A * | 1/1992 | Sato | 315/169.3 |
| 5,952,789 | A * | 9/1999 | Stewart et al. | 315/169.4 |
| 6,307,322 | B1 * | 10/2001 | Dawson et al. | 315/169.1 |
| 6,583,775 | B1 * | 6/2003 | Sekiya et al. | 345/76 |
| 6,947,019 | B2 * | 9/2005 | Sato et al. | 345/82 |
| 7,259,735 | B2 * | 8/2007 | Kasai | 345/77 |
| 7,310,077 | B2 * | 12/2007 | Kane | 345/76 |
| 2005/0156829 | A1 * | 7/2005 | Choi et al. | 345/76 |

* cited by examiner

*Primary Examiner*—Richard Hjerpe
*Assistant Examiner*—Mansour M Said
(74) *Attorney, Agent, or Firm*—Sonnenschein Nath & Rosenthal LLP

(57) ABSTRACT

In a pixel circuit formed by using a MOS process, a constant current is applied from a second transistor (T2) as a constant current source to an organic EL device coupled to a third transistor (T3) so that the organic EL device emits light, during the period when the third transistor (T3) is in the conductive state. The third transistor (T3) is switched on and off based on its gate voltage dependent upon a signal value written to a capacitor (Cs) and a ramp signal voltage (Vcs). Thus, the organic EL device emits light during the period dependent upon the signal value. That is, displaying operation is implemented with gray-scale being controlled according to a video signal value.

10 Claims, 15 Drawing Sheets

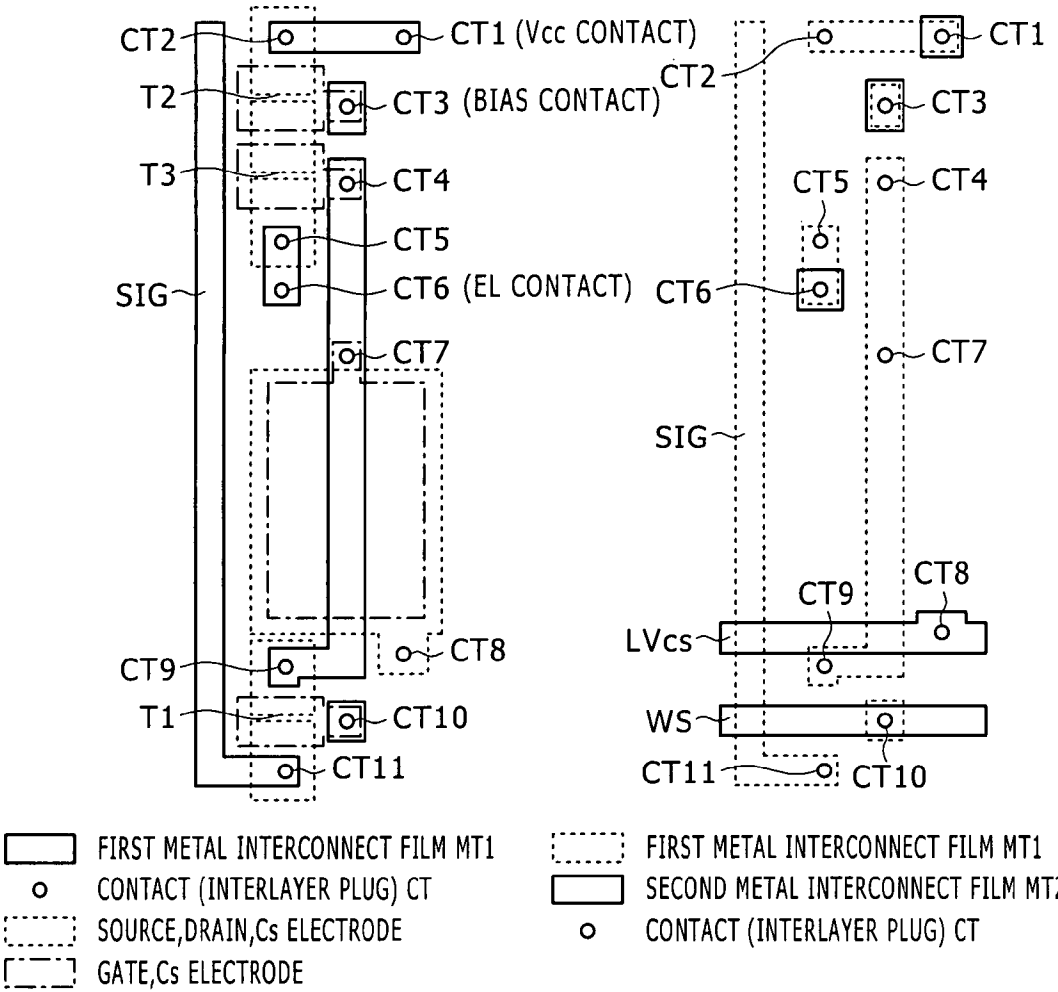
FIG.7A
FIG.7B
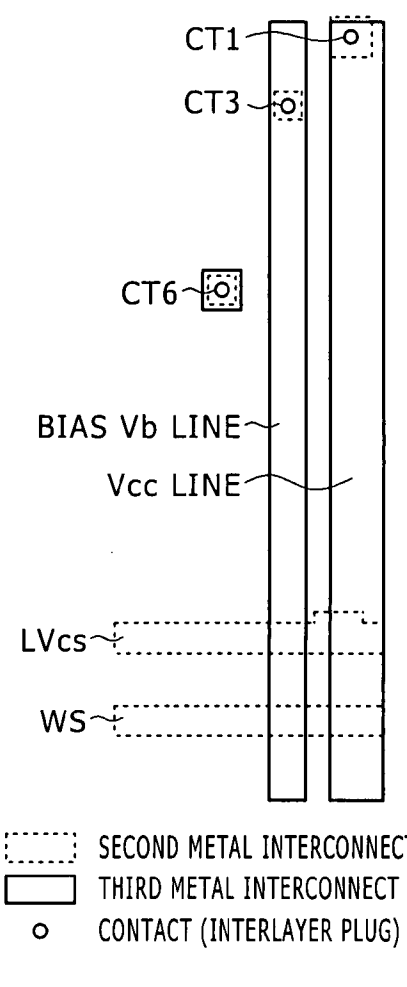
FIG.7C

Prior Art

DISPLAY AND METHOD OF DRIVING PIXEL

CROSS REFERENCES TO RELATED APPLICATIONS

The present invention contains subject matter related to Japanese Patent Application JP 2005-028020 filed in the Japanese Patent Office on Feb. 3, 2005, the entire contents of which being incorporated herein by reference.

BACKGROUND OF THE INVENTION

The present invention relates to a display in which pixel circuits are formed at intersections between signal lines and scan lines and therefore are disposed in a matrix, and particularly to a display employing organic electro-luminescence devices (organic EL devices) as its light-emitting devices. The invention also relates to a method of driving pixels in the display.

In recent years, increasing attention is being paid to organic EL displays as a flat panel display (FPD). Currently, liquid crystal displays (LCD) are predominantly used as FPDs. However, the liquid crystal displays are not self-luminous devices, and therefore requires additional components such as a backlight and polarizer. These additional components inevitably cause disadvantages such as an increase in the thickness of the display and insufficient luminance of the display.

In contrast, organic EL displays are self-luminous devices, and therefore require no additional components such as a backlight in principle. Accordingly, the organic EL displays are advantageous over the LCDs in terms of achieving a small thickness and high luminance of the display. In particular, active-matrix organic EL displays, in which switching devices are formed for each pixel, have advantages of achieving low current consumption due to hold-lighting of each pixel, and of allowing a large-size and high-definition screen comparatively easily. Therefore, the active-matrix organic EL displays have been developed in various manufactures, and are expected to enter the mainstream of future FPDs.

In recent years, personal imaging apparatuses typified by digital still cameras and digital camcorders have been developed. As a finder display device in these apparatuses, an LCOS (Liquid Crystal on Silicon), in which pixel circuits and drive circuits are formed on a crystalline silicon substrate, or a high- or low-temperature polycrystalline silicon LCD is used.

A finder employing a transmissive LCD requires a backlight, and one employing a reflective LCD requires a frontlight. Therefore, the finder employing an LCD inevitably involves a large module thickness, which leads to disadvantages for thickness reduction of the apparatus. In addition, in step with miniaturization of personal imaging apparatuses, the finder itself is miniaturized, which correspondingly reduce the size of pixels in the finder. Accordingly, in a transmissive LCD, it becomes difficult to ensure its aperture sufficiently, and the finder employing a transmissive LCD is getting close to its performance limit. As for a finder employing a reflective LCD, the LCOS is being brought into the mainstream. However, a lighting system is needed similarly, which does not contribute to thickness reduction of the apparatus.

In contrast, if an organic EL device is used as a viewfinder display device, the viewfinder display device can contribute to thickness reduction of the apparatus since the organic EL device is a self-luminous device and therefore requires no lighting system unlike LCDs. In addition, if an organic EL device having a top-emission structure is used, a sufficient aperture ratio for offering favorable performance can be ensured.

In recent years, viewfinders are tracking a trend toward a higher definition. Apparatus manufacturers have demanded for definition enhancement from QVGA (Quarter Video Graphics Array: 320×240 pixels) to VGA (Video Graphics Array: 640×480 pixels), and further to SVGA (Super Video Graphics Array: 800×600 pixels) and XGA (Extended Graphics Array: 1024×768 pixels).

In order to respond to these demands for a higher definition, use of a MOS process like the LCOS is required obviously. Furthermore, it is needed to decrease the number of devices in pixel drive circuits.

Typically pixel circuits for driving organic EL devices need to have a configuration for compensating variation in the threshold voltage and transconductance of transistors. Various techniques for the compensation configuration have been proposed. However, the drive circuit in most of these proposed techniques includes about five transistors. This number is large. In addition, a problem arises when transistors are formed by a MOS process. Specifically, the mobility of MOS transistors is in the range of about 300 to 600 $cm^2/V\cdot s$, and therefore the current supply ability of the transistors is too large to drive high-definition minute pixels.

As a circuit that is suitable for a MOS process and has a small number of devices, the circuit disclosed in PCT Patent Publication No. WO01/54107 is known. This pixel circuit is formed of two transistors and one capacitor.

Description will be made below about the conventional pixel circuit with reference to drawings. FIG. 13 illustrates the conventional pixel circuit. FIG. 14 shows the operation timing of the circuit of FIG. 13.

In the pixel circuit, all transistors are a P-channel transistor. The gate of a sampling transistor T11 is coupled to a scan line WS for controlling sampling of a video signal. The source thereof is coupled to a video signal line SIG, while the drain is coupled to one end of a capacitor Cs and the gate of a drive transistor T12.

The source of the drive transistor T12 is supplied with a supply voltage Vcc, and the drain thereof is coupled to the anode electrode of an organic EL device 4. The cathode of the organic EL device 4 is coupled to a line of a cathode supply voltage Vk.

The other end of the capacitor Cs is coupled to a line LVcs for supplying a voltage Vcs.

The operation of the pixel circuit will be described. At timing tm1 in FIG. 14, a scan pulse to the scan line WS is switched to a low potential, and thus the sampling transistor T11 is turned on. Thus, the potential at a node NA, which is equivalent to one end of the capacitor Cs, is set to the video signal potential. That is, a signal voltage Vs supplied through the video signal line SIG is written to the capacitor Cs.

At this time, the line LVcs for supplying the voltage Vcs to the capacitor Cs is fixed at a certain reference potential Vref (Vcs=Vref).

At timing tm2, the scan pulse to the scan line WS is turned to a high potential, which cuts off the sampling transistor T11. At the timing tm2, the voltage Vcs supplied from the line LVcs to the capacitor Cs is switched to a ramp signal voltage that repeatedly increases with time from the reference potential Vref to the maximum potential Vr. The cycle of the ramp signal is sufficiently shorter than one frame, and is typically set to one horizontal period.

After the timing tm2, in step with the increase of the voltage Vcs as a ramp signal, the potential at the node NA, i.e. the gate voltage of the drive transistor T12 increases from the signal voltage Vs toward the voltage Vs+Vr due to the capacitance coupling of the capacitor Cs. In the voltage increase period, the potential at the node NA reaches the cutoff voltage (the threshold voltage Vth) of the drive transistor T12 at certain timing. Thus, the drive transistor T12 is turned off, which stops supply of a current Iel to the organic EL device 4.

Until the cut-off of the drive transistor T12, that is, during the period when the drive transistor T12 conducts, the current Iel is supplied via the drive transistor T12 to the organic EL device 4, and therefore the organic EL device 4 emits light.

Such operation is implemented not only in the period from the timing tm2 to timing tm3, but also in the period from the timing tm3 to tm4, the period from the timing tm4 to tm5, and so forth. Specifically, after the video signal potential Vs is written in one horizontal period (e.g. tm1-tm2) within one frame, operation similar to that in the period tm2-tm3 is implemented based on a ramp signal in each horizontal period subsequent to the write period within the frame.

The drive transistor T12 operates in its linear region and thus is used as a switching device. Hence, during the period when the drive transistor T12 is in the on-state, the power supply Vcc is directly coupled to the anode of the organic EL device 4, and therefore the organic EL device 4 is driven under so-called constant-voltage drive.

Under the premise that the ramp signal waveform shows linear increases, the time period Ton during which the drive transistor T12 is in the on-state is expressed by Equation 1.

$$Ton=(Vth/Vr)\cdot Th+(Vcc-Vs)/Vr\cdot Th \qquad \text{Equation 1}$$

Note that in Equation 1, Vth denotes the threshold voltage of the drive transistor T12, Vr denotes the amplitude of the voltage Vcs, Vcc denotes the supply voltage, Vs denotes the video signal potential, and Th denotes the cycle of one horizontal period.

The time period Ton during which the drive transistor T12 is in the on-state is equivalent to the time period during which the organic EL device 4 emits light. Specifically, in one horizontal period (1H) for example, the organic EL device 4 emits light for the time period dependent upon the video signal voltage Vs supplied to the node NA. Gray-scale control is allowed by this light emission of the organic EL device 4 for the time period dependent upon the video signal voltage Vs.

Typically the threshold voltage Vth of a transistor varies over time.

Assuming that the threshold voltage Vth varies by ±ΔVth, Equation 2 is obtained from Equation 1.

$$Ton=((Vth\pm\Delta Vth)/Vr)\cdot Th+(Vcc-Vs)/Vr\cdot Th \qquad \text{Equation 2}$$

As Equation 2 shows, the ON time period Ton of the drive transistor T12 also varies.

However, the threshold voltage variation ΔVth of a MOS transistor is about ±10 mV. Therefore, if the ramp signal amplitude Vr is set to a sufficiently large value, e.g. to about 1 V, the threshold voltage variation ΔVth can be suppressed to about 1% of the amplitude Vr, which causes no problem in practice. That is, the ON time period Ton is not greatly affected by the threshold voltage variation ΔVth.

In addition, since gray-scale is controlled based on the ON time period Ton, if the ramp signal amplitude Vr is set to a large value, gray-scale offset and in-plane display roughness attributed to variation in characteristics of the drive transistor T12 among the pixels can be suppressed. Furthermore, since the cycle of the ramp signal equals to the cycle of one horizontal period, the ramp signal frequency is so high that no flicker arises.

However, in the conventional circuit like that shown in FIG. 13, a constant voltage is applied to the organic EL device 4 at the time of light emission thereof.

Typically an organic EL device driven with a constant current has a longer life than that of a device driven with a constant voltage. This respect will be described with reference to FIGS. 15A and 15B.

FIG. 15A shows the current-voltage characteristic (I-V curve) of an organic EL device. FIG. 15B shows the current-luminance characteristic (I-L curve) thereof.

Referring initially to the I-V curves of FIG. 15A, the characteristic of the device in the initial state is indicated by the full line, while the characteristic after deterioration thereof over time is indicated by the dashed line. In the initial characteristic, a voltage Vo offers a current Io. However, after deterioration over time, the same voltage Vo offers a current lower by ΔI than the current Io. That is, when the device is driven with a certain constant voltage Vo, a current flowing through the device decreases by ΔI after deterioration of the device over time.

Referring next to the I-L curves of FIG. 15B, the characteristic of the device in the initial state is indicated by the full line, while the characteristic after deterioration thereof over time is indicated by the dashed line. When the device is driven with a constant current, the luminance decrease associated with the deterioration over time is from the point <A> on the initial curve to the point <B>. In contrast, when the device is driven with a constant voltage, since the current decreases by ΔI as shown in FIG. 15A, the I-L deterioration further advances to the point <C>. That is, the degree of luminance deterioration is larger.

Therefore, constant-current drive is desirable in order to extend the life of an organic EL display. However, the conventional circuit shown in FIG. 13 cannot employ the constant-current drive.

As a circuit different from the circuit in FIG. 13, a pixel circuit that alleviates the influence of variation in transistor characteristics by using a ramp signal is disclosed in Japanese Patent Laid-open No. 2004-246320. The pixel circuit however is based on characteristics of low-temperature polycrystalline silicon, and therefore the number of devices in a basic circuit is large: seven transistors and one capacitor. Accordingly, the pixel circuit is unfavorable for high-definition pixels.

Under the above-described circumstances, there has been a need for a pixel drive circuit that achieves constant-current drive with a small number of devices and alleviates variation in transistor characteristics, to thereby allow a long-life, high-definition, and high-image-quality organic EL display.

In the pixel circuit shown in FIG. 13, during the period from the timing tm1 to tm2 of FIG. 14, for sampling a video signal, the supply voltage Vcc is applied to the organic EL device 4 almost independently of a gray-scale, and thus the current Ip flows through the organic EL device 4. That is, the organic EL device 4 enters a pseudo-emission state during the sampling of a video signal in the period from the timing tm1 to tm2.

In this case, the average current Iave in one frame is expressed by Equation 3.

$$Iave=\{Ip+(Ton/Th)\cdot(Nv-1)\cdot Ip\}/Nv \qquad \text{Equation 3}$$

Note that in Equation 3, Ip denotes the peak current, Ton denotes the ON time period within one horizontal period, Th denotes the cycle of one horizontal period, Nv denotes the number of scan lines.

When black is displayed, Iave equals Ip/Nv since Ton equals 0. Therefore, floating black arises. When white is displayed, Iave equals Ip since Ton equals Th. As a result, the contrast ratio equals Nv. Therefore, the contrast ratio is defined by the number of scan lines, and a contrast ratio larger than Nv cannot be achieved in principle.

Thus, there has also been a need to achieve a pixel drive circuit that allows a long-life and high-definition organic EL display capable of displaying sharp images with a high contrast ratio.

SUMMARY OF THE INVENTION

The present invention is made in consideration of the above-described problems, and a first embodiment thereof is to achieve constant-current drive with a small number of devices and alleviate variation in transistor characteristics, to thereby provide a pixel drive circuit allowing a long-life, high-definition, and high-image-quality organic EL display. A second embodiment thereof is to allow displaying of shape images with a high contrast ratio.

According to one embodiment of the present invention, there is provided a display including pixel circuits that are each formed at an intersection between a signal line and a scan line so that the pixel circuits are disposed in a matrix, each of the pixel circuits comprising: a first transistor of which gate is coupled to the scan line, one of a source and a drain of the first transistor being coupled to the signal line; a second transistor of which gate is supplied with a bias voltage, one of a source and a drain of the second transistor being coupled to a positive voltage supply; a third transistor of which gate is coupled to the other of the source and the drain of the first transistor, the third transistor being coupled to the other of the source and the drain of the second transistor; a capacitor of which one end is coupled to the other of the source and the drain of the first transistor, the other end of the capacitor being supplied with a ramp signal that increases and decreases with time; and an organic electro-luminescence thin film that is driven to emit light by the first, second and third transistors and the capacitor, wherein the first, second and third transistors and the capacitor are formed by a MOS process; the first transistor conducts in response to a scan pulse supplied from the scan line, and a signal value from the signal line is written to the capacitor when the first transistor conducts; the bias voltage is set so that the second transistor operates as a constant current source; and during a period when the third transistor is in a conductive state, or during a period when the third transistor is in a non-conductive state, a constant current from the second transistor flows through the organic electro-luminescence thin film so that the organic electro-luminescence thin film emits light.

a display including pixel circuits that are each formed at an intersection between a signal line and a scan line so that the pixel circuits are disposed in a matrix. Each of the pixel circuits has a configuration in which an organic electro-luminescence thin film is driven to emit light by first, second and third transistors and a capacitor that are formed over crystalline silicon by a MOS process. In each of the pixel circuits, the gate of the first transistor is coupled to the scan line. One of the source and drain of the first transistor is coupled to the signal line, and the other is coupled to one end of the capacitor and the gate of the third transistor. A ramp signal that increases and decreases with time is applied to the other end of the capacitor. The gate of the second transistor is supplied with a bias voltage. One of the source and drain of the second transistor is coupled to a positive voltage supply, and the other is coupled to the third transistor. The first transistor is turned on in response to a scan pulse supplied from the scan line. When the first transistor conducts, a signal value from the signal line is written to the capacitor. The bias voltage is set so that the second transistor operates as a constant current source. During a period when the third transistor is in the conductive state, or during a period when the third transistor is in the non-conductive state, a constant current from the second transistor flows through the organic electro-luminescence thin film so that the organic electro-luminescence thin film emits light.

According to another embodiment of the present invention, there is provided a method of driving a pixel in a display. The display includes pixel circuits that are each formed at an intersection between a signal line and a scan line so that the pixel circuits are disposed in a matrix. Each of the pixel circuits has a configuration in which an organic electro-luminescence thin film is driven to emit light by first, second and third transistors and a capacitor that are formed by a MOS process. The gate of the first transistor is coupled to the scan line. One of the source and drain of the first transistor is coupled to the signal line, and the other is coupled to one end of the capacitor and the gate of the third transistor. A ramp signal that increases and decreases with time is applied to the other end of the capacitor. The gate of the second transistor is supplied with a bias voltage. One of the source and drain of the second transistor is coupled to a positive voltage supply, and the other is coupled to the third transistor. The method includes the steps of setting the bias voltage so that the second transistor operates as a constant current source, turning on the first transistor by use of a scan pulse supplied from the scan line, to thereby write a signal value from the signal line to the capacitor, and switching the third transistor based on a gate voltage dependent upon the signal value written to the capacitor and the ramp signal. A constant current from the second transistor flows through the organic electro-luminescence thin film so that the organic electro-luminescence thin film emits light, during a period when the third transistor is in a conductive state, or during a period when the third transistor is in a non-conductive state.

According to the embodiments, in a pixel circuit formed by using a MOS process, a constant current is applied from a second transistor as a constant current source to an organic EL thin film coupled in series or in parallel to a third transistor so that the organic EL thin film emits light, during the period when the third transistor is in the conductive state or in the non-conductive state.

The third transistor is switched on and off based on its gate voltage dependent upon the signal value written to the capacitor and the ramp signal. Thus, the organic EL thin film emits light during the period dependent upon the signal value. That is, displaying operation is implemented with gray-scale being controlled according to a video signal value.

According to the embodiments of the present invention, in each pixel circuit formed by a MOS process in an organic EL display, a drive transistor (third transistor) is controlled with using a signal value (analog video signal potential) and a ramp signal that increases and decreases with time. Thus, a current produced by a constant current source transistor (second transistor) that is controlled with a DC bias, is subjected to constant-current pulse width modulation, which is less susceptible to variation in transistor characteristics. By thus driving, with a constant current, the organic EL thin film to emit light, an organic EL device having a long life is achieved with a pixel circuit configuration including a small number of devices. In addition, this small susceptibility to transistor characteristic variation and the pixel circuit configuration including a small number of devices offer advantages for enhancing definition and image quality.

Furthermore, as the bias voltage, the R pixel bias voltage, the G pixel bias voltage, and the B pixel bias voltage may be separately set for the R pixel circuit, the G pixel circuit, and the B pixel circuit, respectively. This separate setting allows application, to each organic EL thin film, of current of an adequate amount corresponding to the emission efficiency and color visibility of each of the colors R, G and B. Therefore, the image quality can be enhanced, and white balance adjustment is allowed due to the bias setting.

During the period when the first transistor conducts (i.e. the period for writing a signal value to the capacitor), a certain reference voltage is applied to the other end of the capacitor. If the certain reference voltage is higher than the threshold voltage of the third transistor, the third transistor can surely be set to the non-conductive state (when the third transistor is coupled in series to the organic EL thin film), or to the conductive-state (when the third transistor is coupled in parallel with the organic EL thin film) during the write period. Thus, pseudo-emission of the organic EL thin film can be avoided. Thus, an organic EL display with a high contrast can be achieved.

BRIEF DESCRIPTION OF THE DRAWINGS

FIGS. 7A, 7B and 7C are explanatory diagrams of a layout for forming the pixel circuit according to the first embodiment;

DETAILED DESCRIPTION OF THE PREFERRED EMBODIMENTS

The entire configuration of a display according to one embodiment of the present invention will be described below. Thereafter, the configurations of pixel circuits and operations thereof according to first to fourth embodiments of the invention will be described.

Configuration of Display

Figure 1:
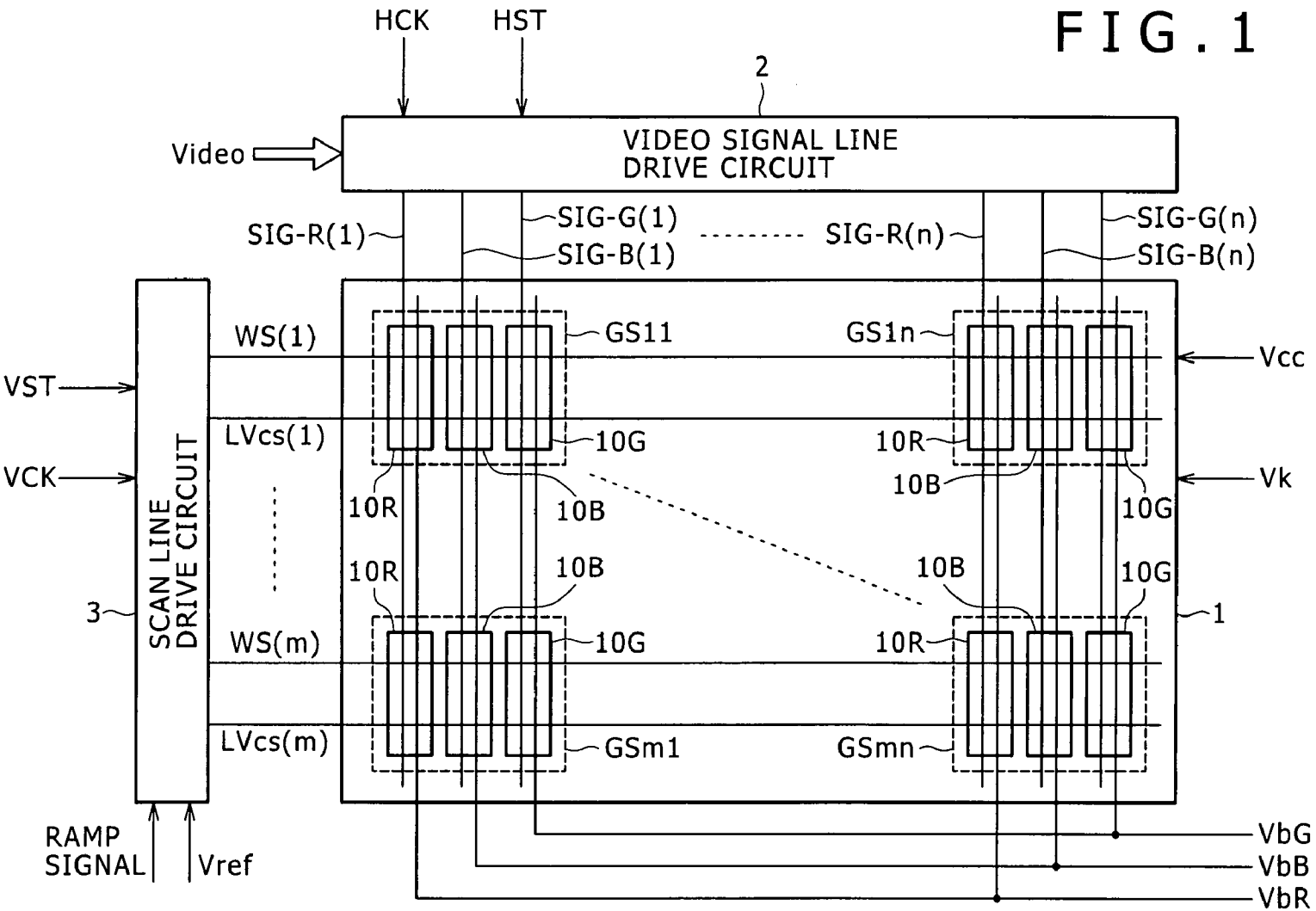
FIG. 1 is a block diagram of the configuration of a display according to one embodiment of the present invention.

FIG. 1 illustrates the configuration of a display according to one embodiment of the invention. In the display of the present embodiment, color pixel units GS as components of a pixel array 1 are arranged in a matrix of m rows and n columns.

One color pixel unit includes a red (R) pixel circuit 10R, a blue (B) pixel circuit 10B, and a green (G) pixel circuit 10G. Such color pixel units GS11 to GSnm are arranged in a matrix. FIG. 1 illustrates only color pixel units GS11, GS1*n*, GSm1 and GSnm on four corners of the pixel array 1, and the illustration of other pixel units is omitted.

For such a pixel array 1, a video signal line drive circuit 2 and a scan line drive circuit 3 are provided.

Input to the video signal line drive circuit 2 are a horizontal clock HCK, a horizontal start signal HST and a video signal (Video). Based on these signals, the video signal line drive circuit 2 supplies, in each horizontal period, a video signal to a video signal line SIG disposed on each of columns of the pixel array 1.

Provided as the video signal lines SIG are video signal lines SIG-R for the R pixel circuits 10R arranged in the column direction, video signal lines SIG-B for the B pixel circuits 10B arranged in the column direction, and video signal lines SIG-G for the G pixel circuits 10G arranged in the column direction. Since the color pixel units GS are arranged on n columns, the video signal lines SIG-R(1) to SIG-R(n), SIG-B(1) to SIG-B(n), and SIG-G(1) to SIG-G(n) are provided for the pixel array 1. In each one horizontal period, the video signal line drive circuit 2 supplies to these video signal lines SIG, R video signals, B video signals and G video signals corresponding to the respective pixels on one row.

The scan line drive circuit 3 is provided with a vertical scan clock VCK, a vertical start signal VST, a ramp signal, and a reference voltage Vref. The ramp signal is a sawtooth signal in which, for example, a voltage value repeatedly increases from 0 to the maximum value with the cycle of one horizontal period.

Based on these signals, the scan line drive circuit 3 supplies a scan pulse to the scan line WS disposed on each of rows of the pixel array 1, and drives a voltage applying line LVcs.

Since the pixel array 1 includes the pixels of m rows, scan lines WS(1) to WS(m) are provided as the scan lines WS, and voltage applying lines LVcs(1) to LVcs(m) are provided. Within one frame period, the scan line drive circuit 3 applies, in each one horizontal period, a scan pulse for sequentially selecting a respective one of the scan lines WS(1) to WS(m).

Supplied to each pixel circuit 10 (10R, 10B and 10G) are a scan pulse and the voltage Vcs from the scan line WS and the voltage applying line LVcs, respectively, on a corresponding one of the rows.

The configuration of the scan line drive circuit 3 will be described later with reference to FIG. 5.

Each pixel circuit 10 (10R, 10B and 10G) of the pixel array 1 is supplied with the supply voltage Vcc and the cathode voltage Vk.

In addition, a bias voltage VbR, a bias voltage VbB, and a bias voltage VbG are provided to the R pixel circuits 10R, the B pixel circuits 10B, and the G pixel circuits 10G, respectively, in the pixel array 1.

First Embodiment

Description will be made about the first to fourth embodiments, which are embodiments relating to the pixel circuit 10 (10R, 10B and 10G) in the display of FIG. 1.

Figure 2:
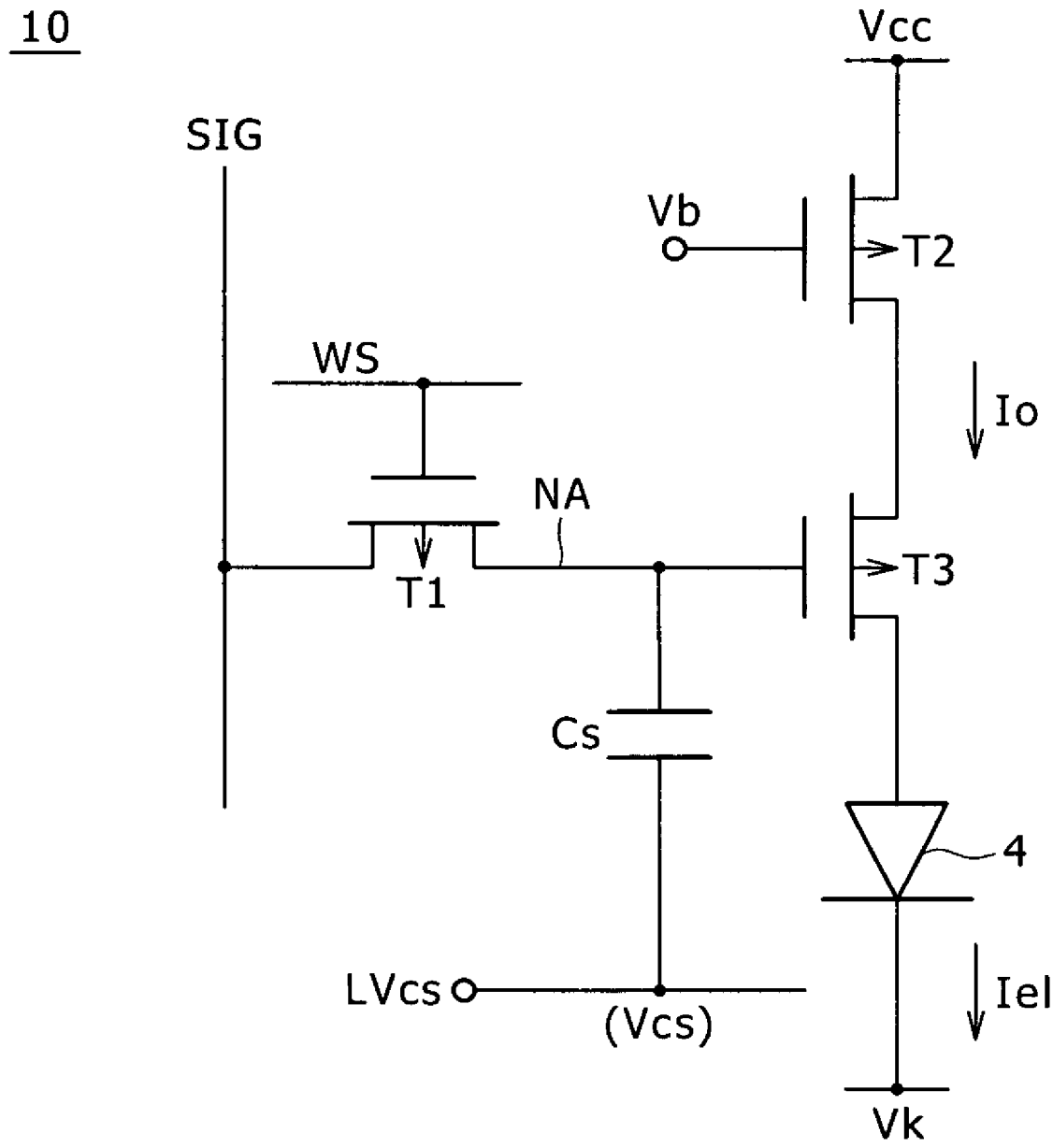
FIG. 2 is a circuit diagram of a pixel circuit according to a first embodiment of the invention.

FIG. 2 illustrates the pixel circuit 10 according to the first embodiment.

The pixel circuit 10 includes three P-channel transistors T1, T2 and T3, and one capacitor Cs, in order to drive the organic EL device 4.

The gate of the first transistor T1 (sampling transistor T1, hereinafter) is coupled to the scan line WS for controlling sampling of a video signal. The drain of the sampling transistor T1 is coupled to the video signal line SIG, and the source thereof is coupled to one end of the capacitor Cs and the gate of the third transistor T3 (drive transistor T3, hereinafter). The gate node of the drive transistor T3 is indicated as the node NA in FIG. 2.

The other end of the capacitor Cs is coupled to the voltage applying line LVcs, and the voltage Vcs is applied to the capacitor Cs by the scan line drive circuit 3.

The source of the second transistor T2 (current source transistor T2, hereinafter) is coupled to a line of the supply voltage Vcc, and the gate thereof is coupled to a line of the bias supply voltage Vb for current adjustment. The drain thereof is coupled to the source of the drive transistor T3.

The drain of the drive transistor T3 is coupled to the anode of the organic EL device 4. The cathode of the organic EL device 4 is coupled to a line of the cathode supply voltage Vk.

The current source transistor T2 is designed to operate in its saturation region, and therefore a constant current Io flows therefrom. The bias potential Vb is set so that the current Io has a current value required in the driven organic EL device 4. For example, if a current of 5 nA is needed to obtain a luminance of 200 nit, the constant current Io is set to 5 nA.

During the period when the drive transistor T3 is in the on-state, the constant current Io flows through the organic EL device 4 as a current Iel, which causes the organic EL device 4 to emit light.

Figure 3:
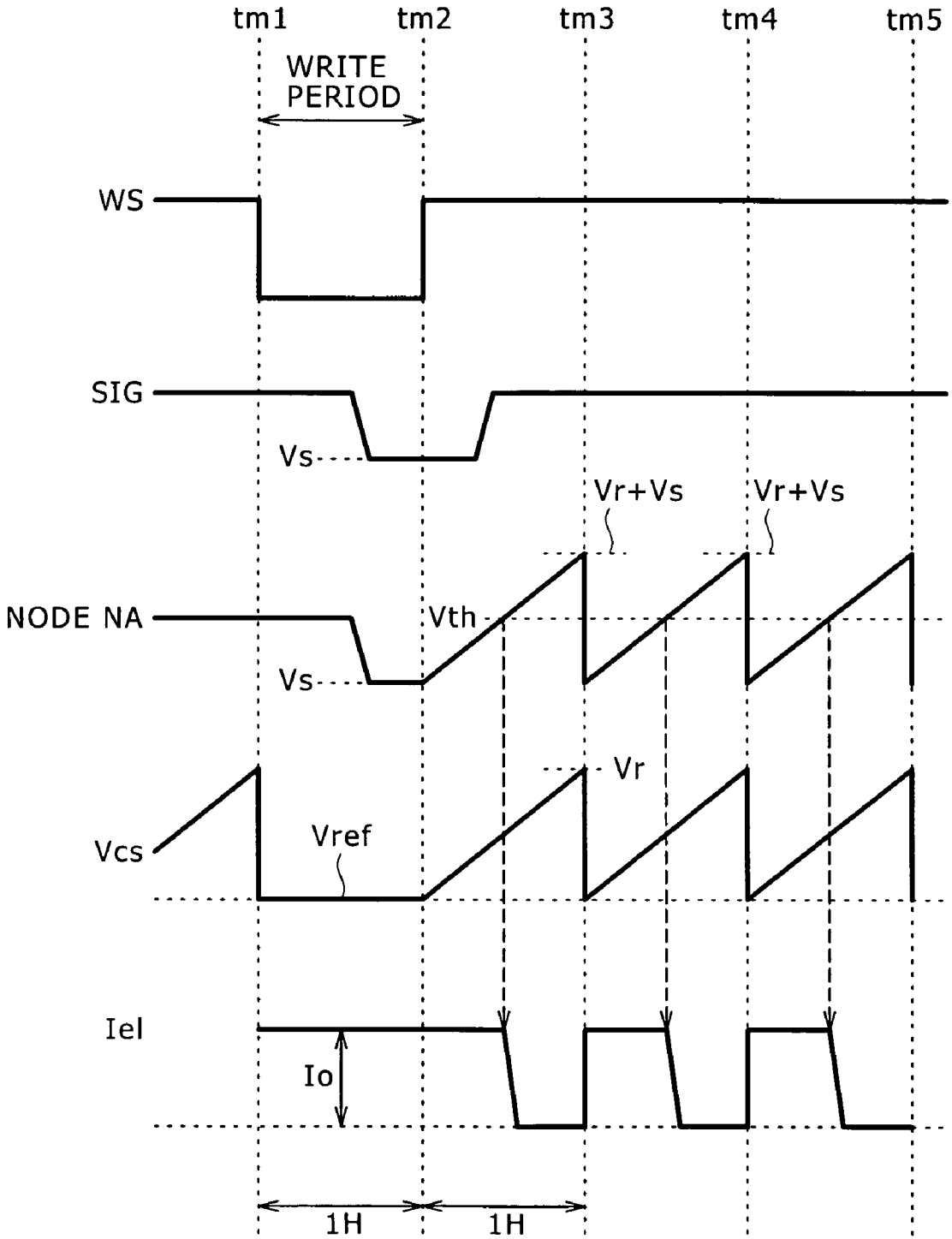
FIG. 3 is an explanatory diagram of the operation of the pixel circuit according to the first embodiment.

FIG. 3 shows an operation principle of the pixel circuit 10 in FIG. 2.

Initially at timing tm1, a scan pulse to the scan line WS is switched to a low potential, and thus the sampling transistor T1 is turned on. Thus, a video signal is charged in the capacitor Cs through the video signal line SIG, which turns the potential at the node NA to the video signal potential Vs. During the period when the sampling transistor T1 is in the on-state, the voltage Vcs from the voltage applying line LVcs is fixed at the reference potential Vref. The reference potential Vref is typically set to the ground level.

That is, the period from the timing tm1 to tm2, during which a scan pulse to the scan line WS is at a low potential, is a write period of a video signal, and is a period during which the potential at the node NA is turned to the video signal potential Vs since the reference voltage Vref is at the ground level.

At the timing tm2, the scan line WS is switched to a high potential, which turns off the sampling transistor T1. Simultaneously, the voltage Vcs from the voltage applying line LVcs is switched to a ramp signal voltage of which voltage value increases with time from the reference voltage Vref to the voltage Vr. The cycle of the ramp signal is set to be sufficiently shorter than one frame period. For example, the cycle of one horizontal period (1H) is adequate as the ramp signal cycle.

In step with the increase of the voltage Vcs, the potential at the node NA rises from the signal potential Vs toward the potential Vs+Vr due to charge holding by the capacitor Cs. In the voltage increase period, when the potential at the node NA reaches the threshold voltage Vth of the drive transistor T3, the drive transistor T3 is cut off, which stops supply of a current to the organic EL device 4. Until the cut off, that is, during the period when the drive transistor T3 is in the on-state, the constant current Io determined based on the current source transistor T2 and the bias potential Vb flows through the organic EL device 4.

Such operation is implemented not only in the period from the timing tm2 to timing tm3, but also in the period from the timing tm3 to tm4, the period from the timing tm4 to tm5, and so forth. Specifically, after the video signal potential Vs is written in one horizontal period (e.g. tm1 to tm2) within one frame, operation similar to that in the period tm2-tm3 is implemented in each horizontal period subsequent to the write period within one frame period, according to the increase of the voltage Vcs with time as a ramp signal voltage.

The time period Ton during which the drive transistor T3 is in the on-state is expressed by Equation 1, i.e. $Ton=(Vth/Vr)\cdot Th+(Vcc-Vs)/Vr\cdot Th$. When the voltage Vr, i.e. the amplitude of the ramp signal is sufficiently large, the time period Ton is almost independent of variation in the threshold voltage Vth of the drive transistor T3.

Specifically, the threshold voltage variation ΔVth of a MOS transistor is about ±10 mV. Therefore, if the ramp signal amplitude Vr is set to a sufficiently large value, e.g. to about 1 V, the threshold voltage variation ΔVth can be suppressed to about 1% of the amplitude Vr, which prevents the ON time period Ton from being greatly affected by the threshold voltage variation ΔVth.

As a result, the brightness Y visually recognized by a human is expressed by the equation $Y=Io\cdot Ton$. Therefore, gray-scale is controlled based on the ON time period Ton.

Since gray-scale is thus controlled based on the ON time period Ton, if the ramp signal amplitude Vr is set to a large value, gray-scale offset and in-plane display roughness attributed to variation in characteristics of the drive transistor T3 among the pixels can be suppressed. Furthermore, since the cycle of the ramp signal equals to the cycle of one horizontal period, the ramp signal frequency is so high that no flicker arises.

Figure 15A:
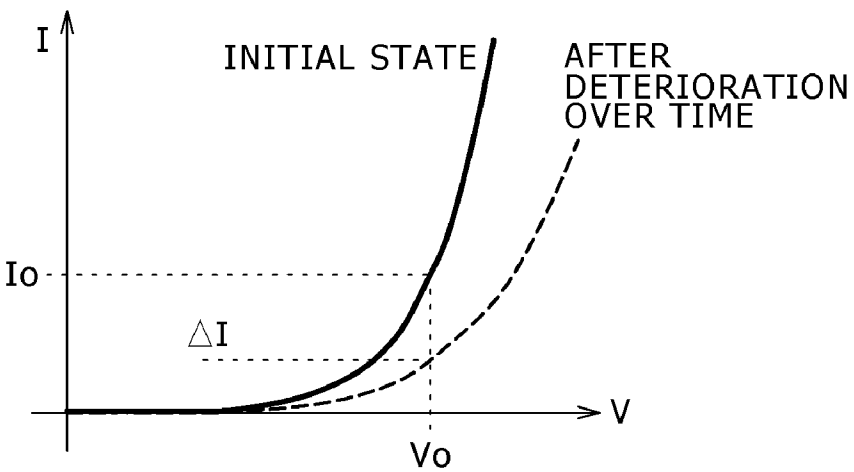
FIGS. 15A and 15B are explanatory diagrams of deterioration of an organic EL device over time.
Figure 15B:
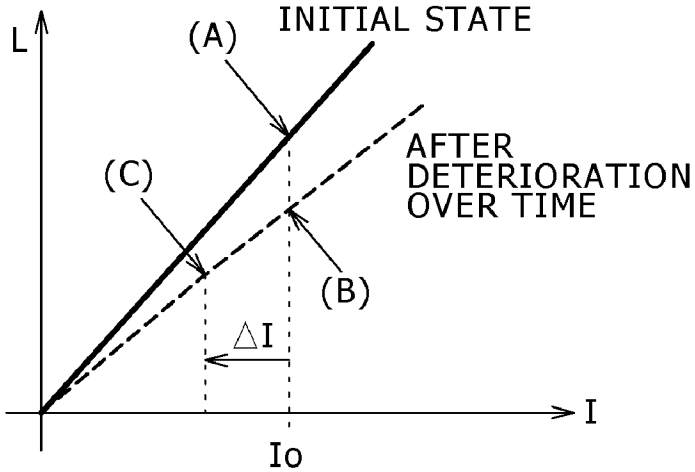
Prior Art FIG. 15B

In the pixel circuit 10, the organic EL device 4 is driven with the constant current Io during the emission period thereof. Therefore, the deterioration of the device is smaller than that of a device driven with a constant voltage. Specifically, referring again to FIGS. 15A and 15B, if the current Io offers the luminance on the point <A> in the initial state as shown in FIG. 15B, the luminance decrease associated with deterioration over time is from the point <A> to <B>. This decrease degree is smaller than that of a conventional pixel circuit, of which luminance decreases to the point <C> due to deterioration. Thus, the life of the EL device can be extended.

Figure 4:
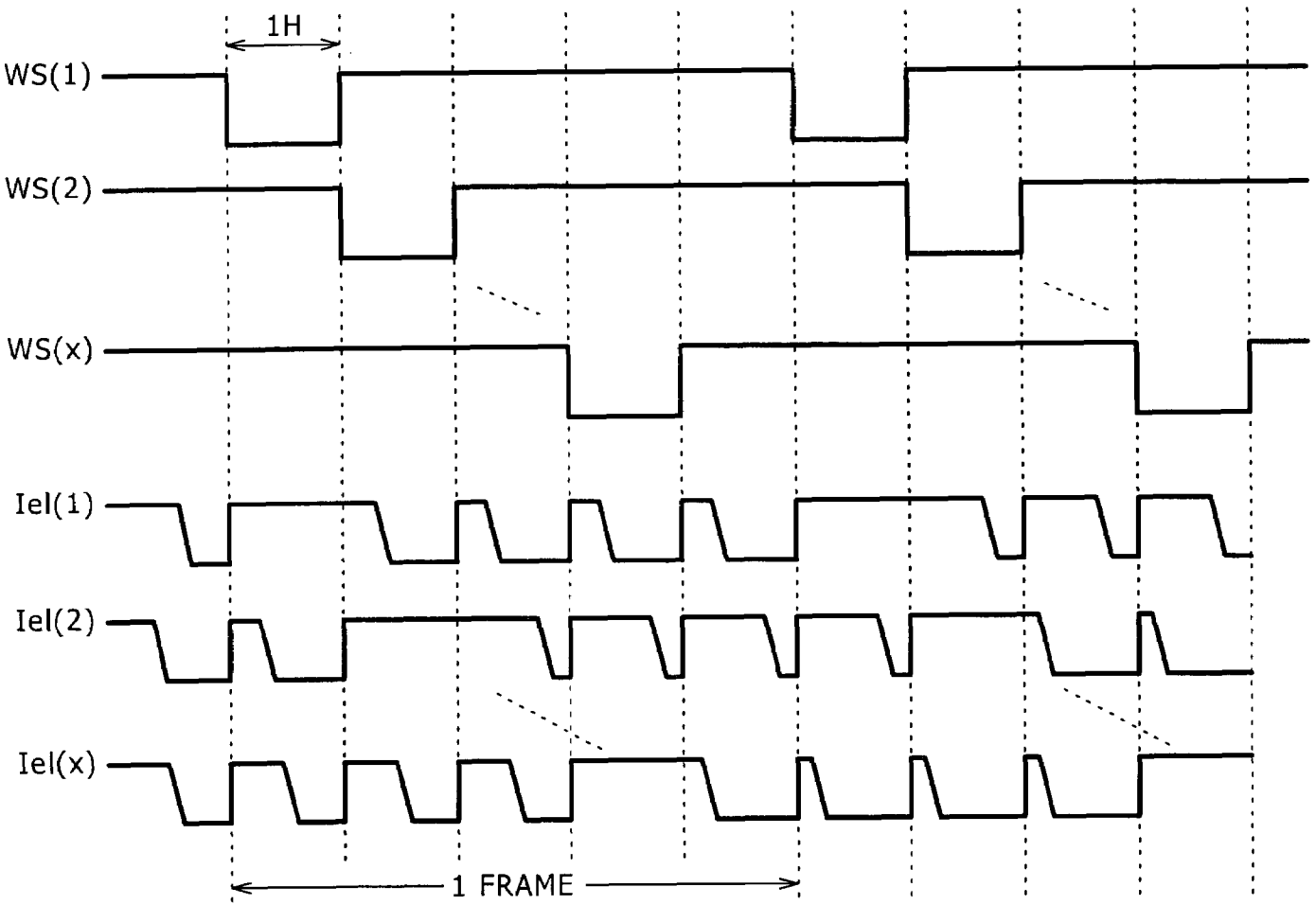
FIG. 4 is an explanatory diagram of the operation, in one frame, of the pixel circuit according to the first embodiment.

FIG. 4 schematically shows the operation, in one frame, of the pixel circuit 10 included in the display of FIG. 1.

The scan lines WS(1), WS(2), . . . , WS(x), . . . on the respective rows are supplied with scan pulses from the scan line drive circuit 3 so as to be sequentially selected. Thus, the pixel circuits 10 on each row implement the above-described write operation during the period when the corresponding scan pulse is at the low level, equivalent to the period from the timing tm1 to tm2 in FIG. 3. Subsequently, each pixel circuit 10 applies the current Iel to the organic EL device 4 to drive it to emit light during the periods dependent upon switching of the drive transistor T3, i.e. during the periods dependent upon the video signal potential Vs supplied through the video signal line SIG. As shown in FIG. 4, in the pixel circuits 10 on each row, the application time period of the constant current Io varies depending on a video signal written on each frame basis, as indicated with each of the currents Iel(1), Iel(2), . . . , Iel(x), . . . to the organic EL devices 4.

A configuration example of the scan line drive circuit 3 will be described with reference to FIG. 5.

In the scan line drive circuit 3, an m-stage shift register including registers 21(1) to 21(*m*) are formed corresponding to the respective rows of the pixel array 1. The vertical start pulse VST is input to the register 21(1), and each of the registers 21(1) to 21(*m*) outputs the vertical start pulse VST and transmits it to the subsequent stage in accordance with the vertical scan clock VCK of which cycle equals to the cycle of one horizontal period.

Each of the registers 21(1) to 21(*m*) is provided with a level shift circuit 22, a buffer amplifier 23, switches 24 and 26, and an inverter 25. FIG. 4 illustrates only the circuitry for the register 21(1).

The pulse is output from the register 21(1) to the level shift circuit 22. The level shift circuit 22 shifts the level of the pulse, to thereby produce a scan pulse of which low and high potentials are 0 V and 6 V, respectively, for example. The scan pulse is then output via the buffer amplifier 23 to the scan line WS(1).

Each of the subsequent registers 21(2) to 21(*m*) outputs a scan pulse through similar circuitry to a corresponding one of the scan lines WS(2) to WS(m). Thus, as shown in FIG. 4, the scan pulses for sequentially selecting the rows are applied to the pixel array 1.

Input to a terminal 27 is a ramp signal that has the amplitude Vr and of which one cycle is equivalent to one horizontal period as described above. In addition, a terminal 28 is supplied with the reference voltage Vref as the ground potential (0 V) for example.

The switch 24 is fed with the scan pulse from the level shift circuit 22 as a control pulse, so as to be turned on and off. In contrast, the switch 26 is fed with, as its control pulse, an inverted signal of the scan pulse, resulting from inversion by the inverter 25, so as to be turned on and off. The switches 24 and 26 are turned on when the corresponding scan pulse is at a high potential.

Accordingly, during the period when the scan pulse to the scan line WS is at a low potential, the reference voltage Vref is applied to the voltage applying line LVcs. In contrast, during the period when the scan pulse to the scan line WS is at a high potential, a ramp signal is applied to the voltage applying line LVcs. As a result, the voltage Vcs applied to the other end of the capacitor Cs in the pixel circuit 10 has a waveform like that shown in FIG. 3.

Figure 6:
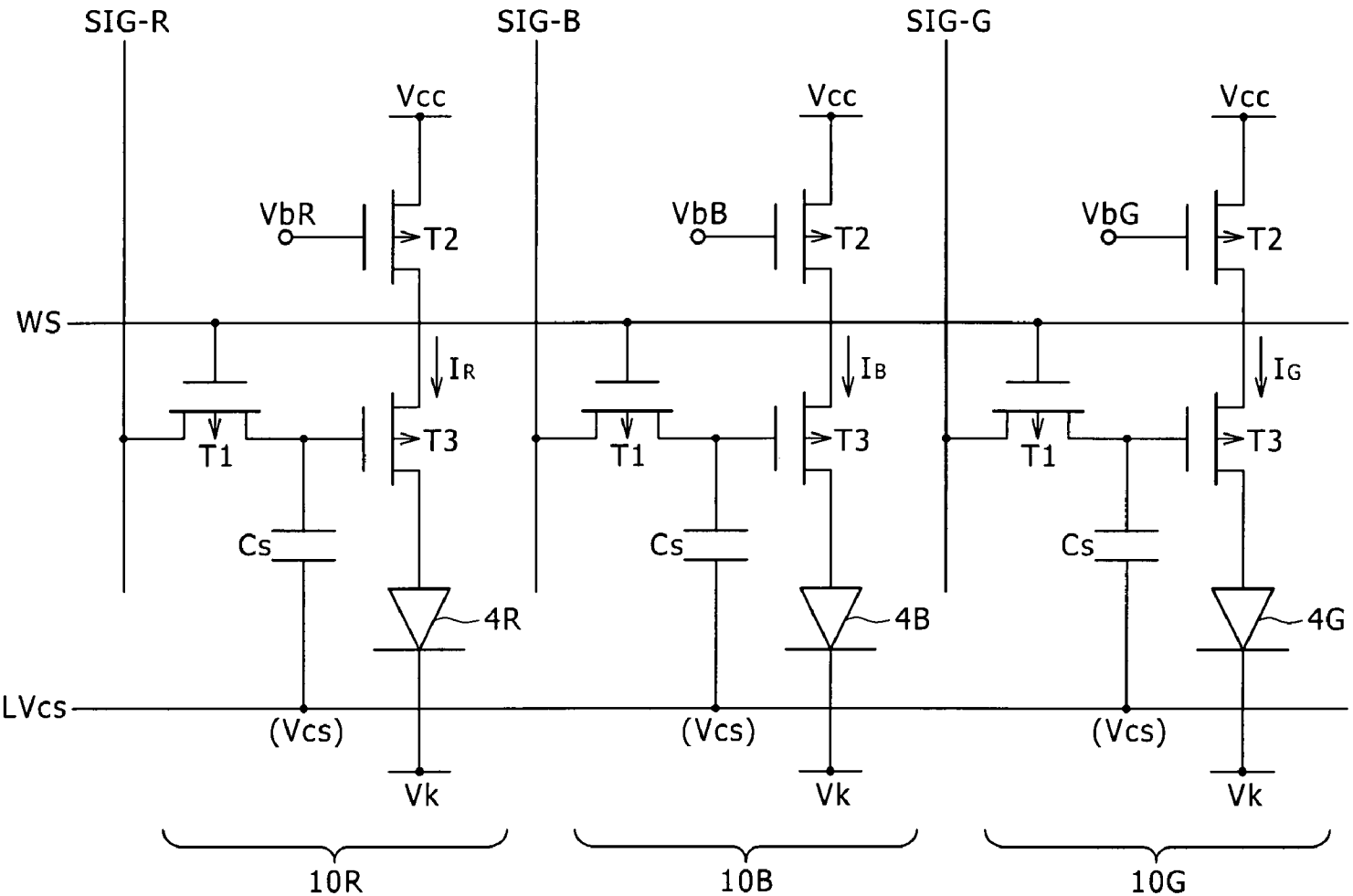
FIG. 6 is an explanatory diagram of R, G and B pixel circuits according to one embodiment of the invention.

Although FIG. 2 shows only one pixel circuit 10, one color pixel unit GS includes the R pixel circuit 10R, the B pixel circuit 10B, and the G pixel circuit 10G as described with FIG. 1. FIG. 6 illustrates the circuit configuration of one color pixel unit GS.

Each of the R pixel circuit 10R, the B pixel circuit 10B, and the G pixel circuit 10G has a configuration similar to that of FIG. 2, and implements operation similar to that of FIG. 3. Thus, in the R pixel circuit 10R, an organic EL device 4R is driven to emit light during the period dependent upon an R video signal potential supplied through the video signal line SIG-R. Similarly, in the B pixel circuit 10B and the G pixel circuit 10G, organic EL devices 4B and 4G are driven to emit light during the periods dependent upon a B video signal potential and a G video signal potential supplied through the video signal lines SIG-B and SIG-G, respectively.

The pixel circuits 10R, 10B and 10G implement constant-current drive for the organic EL devices 4R, 4B and 4G, respectively. The bias voltage Vb for the constant-current drive is set for each of R, B and G separately. Specifically, for the R pixel circuit 10R, a bias voltage VbR is set to determine the value of a constant current IR. For the B pixel circuit 10B, a bias voltage VbB is set to determine the value of a constant current IB. For the G pixel circuit 10G, a bias voltage VbG is set to determine the value of a constant current IG.

By thus setting bias potentials on each color basis, the peak currents can be set through white balance adjustment in color displaying. Therefore, due to the white balance adjustment, adjustment can be carried out from the external through setting of DC potentials, without adjusting the transistor size. Accordingly, there is no need to set the dynamic range of video signals for each color, which can simplify external circuitry.

Furthermore, variation in transistor characteristics among chips can easily be corrected by changing external bias supply potentials.

The emission efficiency and color visibility are different for each of colors R, B and G. Setting of the bias voltages VbR, VbB and VbG also allows adjustment for the differences. In addition, although the emission efficiency varies also depending on the materials of thin films in the organic EL device 4, adjustment for the variation is also allowed.

For example, such adjustment is available that the currents IR, IB and IG have current values of 1.8 nA, 3 nA and 5 nA, respectively.

Figure 8:
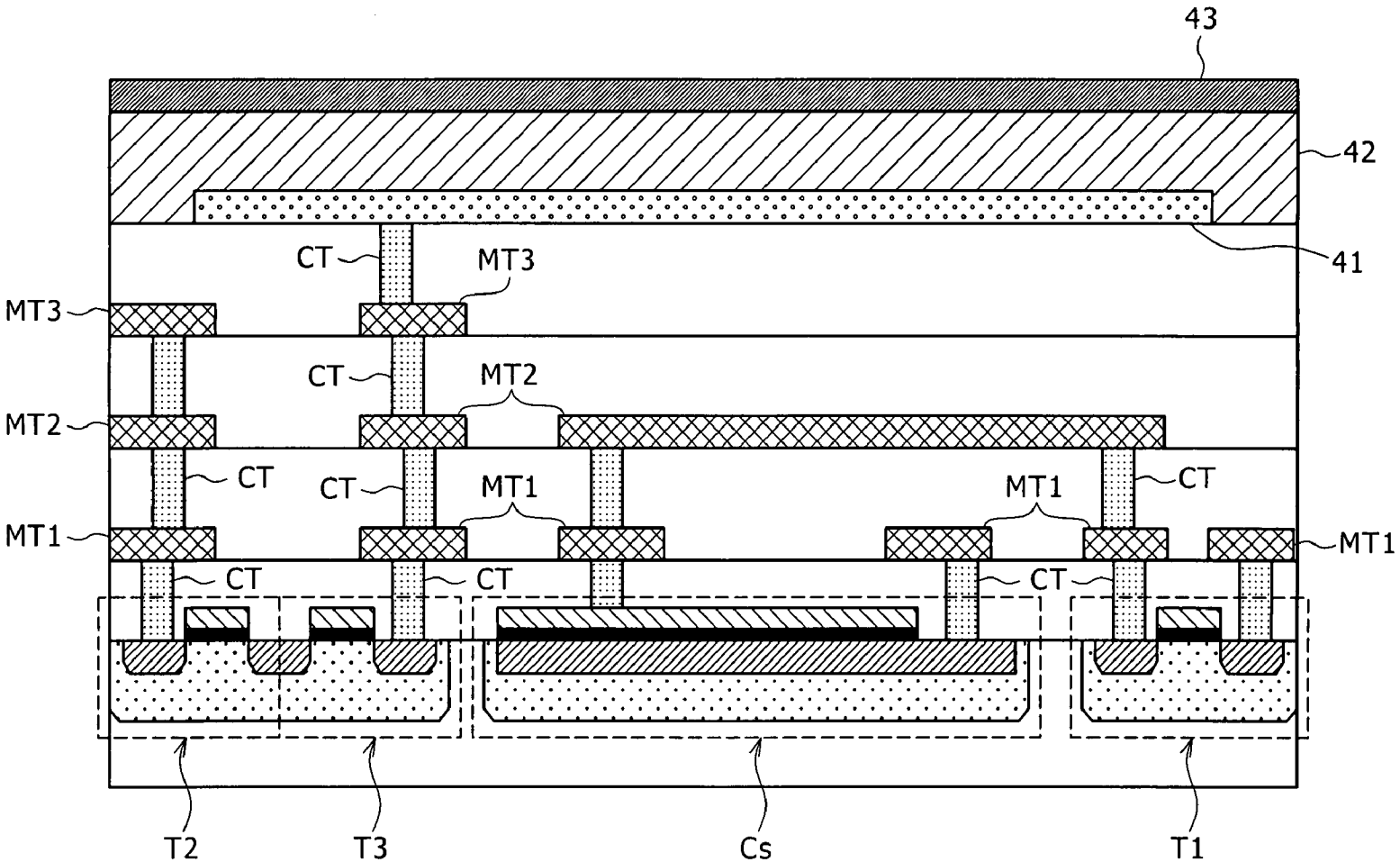
FIG. 8 is a schematic explanatory diagram of the sectional structure of a pixel circuit according to one embodiment of the invention.

The pixel circuit 10 of FIG. 2 is formed through a MOS process. FIGS. 7A to 7C are layout diagrams of a specific configuration for obtaining the pixel circuit 10. FIG. 8 schematically illustrates an example of the sectional structure of an organic EL pixel circuit.

Referring initially to FIG. 8, the configuration of the pixel circuit 10 formed through a MOS process will be described. As publicly known, in a MOS process, a requisite circuit is formed through the various steps. Specifically, addition and diffusion of impurities are implemented for a crystalline silicon substrate (silicon wafer), and a poly-silicon film, an oxide film, an interlayer insulating film and so on are deposited over the substrate, to thereby form transistors. In addition, metal interconnect films made of aluminum, copper or the like for interconnecting devices are formed.

In the organic EL pixel circuit of the present example, as shown in the drawing, the transistors T1, T2 and T3 and the capacitor Cs are formed, and metal interconnect films (a first metal interconnect film MT1, a second metal interconnect film MT2, and a third metal interconnect film MT3) are formed on three layers. Interlayer plugs CT as contacts are formed on the layers so that the layers are electrically coupled to each other.

Over the uppermost layer, an anode electrode 41, an EL thin film 42, and a cathode electrode 43 are formed by vapor deposition.

In the pixel circuit 10 of FIG. 2, the drain of the drive transistor T3 is coupled to the anode of the organic EL device 4. In order to obtain this configuration, as shown in FIG. 8, the drain region of the drive transistor T3 is coupled to the anode electrode 41 via the interlayer plugs CT and the metal interconnect films MT1, MT2 and MT3 for example.

FIG. 8 is a merely schematic diagram of the layer structure. A specific layout example corresponding to the pixel circuit 10 of FIG. 2 is illustrated in FIGS. 7A to 7C.

FIG. 7A illustrates the first metal interconnect film MT1 and layers under the first metal interconnect film MT1. FIG. 7B illustrates the first metal interconnect film MT1 and the second metal interconnect film MT2. FIG. 7C illustrates the second metal interconnect film MT2 and the third metal interconnect film MT3. In each drawing, the interlayer plug (contact) CT as a contact between upper and lower layers is indicated by a circle.

Referring to FIG. 7A, source regions, drain regions and one electrode region of the capacitor Cs are indicated by a dashed line, while gate regions and the other electrode region of the capacitor Cs are indicated by a chain line. These regions form the sampling transistor T1, the current source transistor T2, the drive transistor T3 and the capacitor Cs as shown in the drawing.

In addition, the first metal interconnect films MT1 indicated by a full line form the video signal line SIG and requisite interconnects among the devices.

Referring to FIG. 7B, the first metal interconnect films MT1 and the second metal interconnect films MT2 are indicated by a dashed line and a full line, respectively. The second metal interconnect films MT2 form the scan line WS and the voltage applying line LVcs.

Referring to FIG. 7C, the second metal interconnect films MT2 and the third metal interconnect films MT3 are indicated by a dashed line and a full line, respectively. The third metal interconnect films MT3 form the supply voltage Vcc line and the bias voltage Vb line.

Referring to FIG. 7A, the video signal line SIG formed of the first metal interconnect film MT1 is coupled via a contact CT11 to the drain region (dashed line part) of the sampling transistor T1.

The gate region (chain line part) of the sampling transistor T1 is coupled via a contact CT10 to the scan line WS formed of the second metal interconnect film MT2 in FIG. 7B.

The source region (dashed line part) of the sampling transistor T1 in FIG. 7A is coupled via a contact CT9 to the interconnect formed of the first metal interconnect film MT1, and is coupled via a contact CT4 to the gate region (chain line part) of the drive transistor T3. In addition, the interconnect formed of the first metal interconnect film MT1 is coupled via a contact CT7 to one electrode (chain line part) of the capacitor Cs.

The other electrode (dashed line part) of the capacitor Cs is coupled via a contact CT8 to the voltage applying line LVcs formed of the second metal interconnect film MT2 in FIG. 7B.

The drain region (dashed line part) of the drive transistor T3 in FIG. 7A is coupled via a contact CT5 to the first metal interconnect film MT1, and is coupled via a contact CT6 to the second metal interconnect film MT2 and the third metal interconnect film MT3 in FIGS. 7B and 7C. Moreover, the third metal interconnect film MT3 coupled to the drain region is coupled via the contact CT6 to the anode electrode 41 (not shown) on the top layer.

The source region of the drive transistor T3 and the drain region of the current source transistor T2 in FIG. 7A are formed as a continuous region (dashed line part). The gate region (chain line part) of the current source transistor T2 is coupled via a contact CT3, the first metal interconnect film MT1, and the second metal interconnect film MT2 to the bias voltage Vb line formed of the third metal interconnect film MT3 in FIG. 7C.

The source region (dashed line part) of the current source transistor T2 is coupled via a contact CT2 to the first metal interconnect film MT1. This first metal interconnect film MT1 is coupled via a contact CT1 and the second metal interconnect film MT2 to the supply voltage Vcc line formed of the third metal interconnect film MT3 in FIG. 7C.

The pixel circuit 10 is formed of the above-described layout. For example, the pixel circuit 10 is available that has a vertical and horizontal size of about 9.0 μm by 3.0 μm.

The description thus far is about the pixel circuit 10 according to the first embodiment. An organic EL display including such pixel circuits 10 employs an improved way of driving the organic EL devices 4. Specifically, each organic EL pixel circuit formed of a MOS process supplies the organic EL device 4 with the current Io that is produced by the constant current source transistor T2 controlled by the DC bias Vb, while controlling the supply of the current Io by use of the drive transistor T3 that is switched on and off based on the analog video signal potential Vs and a ramp signal of which voltage value increases and decreases with time. Thus, constant-current pulse width modulation, which is less susceptible to the influence of variation in transistor characteristics, is carried out, which allows a long-life, high-definition, and high-image-quality organic EL display including a small number of devices.

Second Embodiment

A pixel circuit 10 according to the second embodiment will be described with reference to FIGS. 9 and 10.

Figure 9:
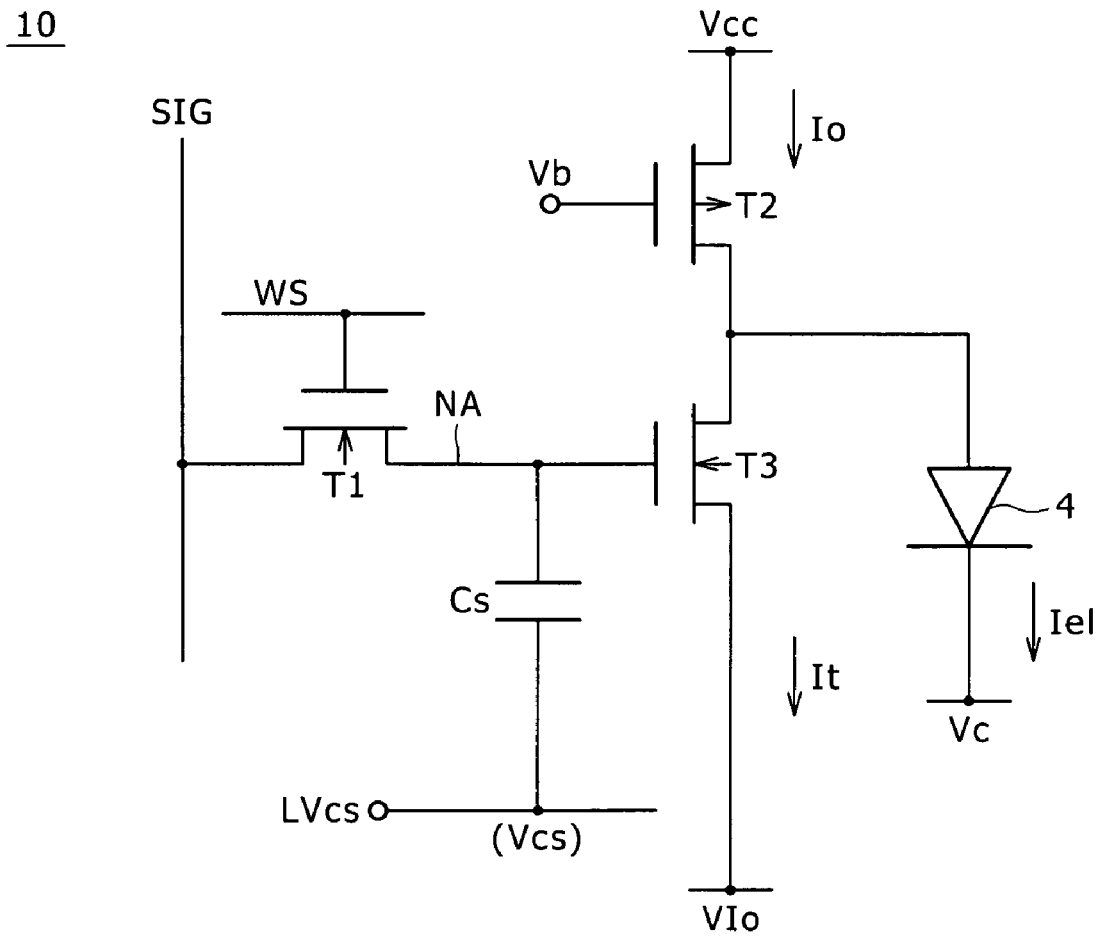
FIG. 9 is a circuit diagram of a pixel circuit according to a second embodiment of the invention.
Figure 10:
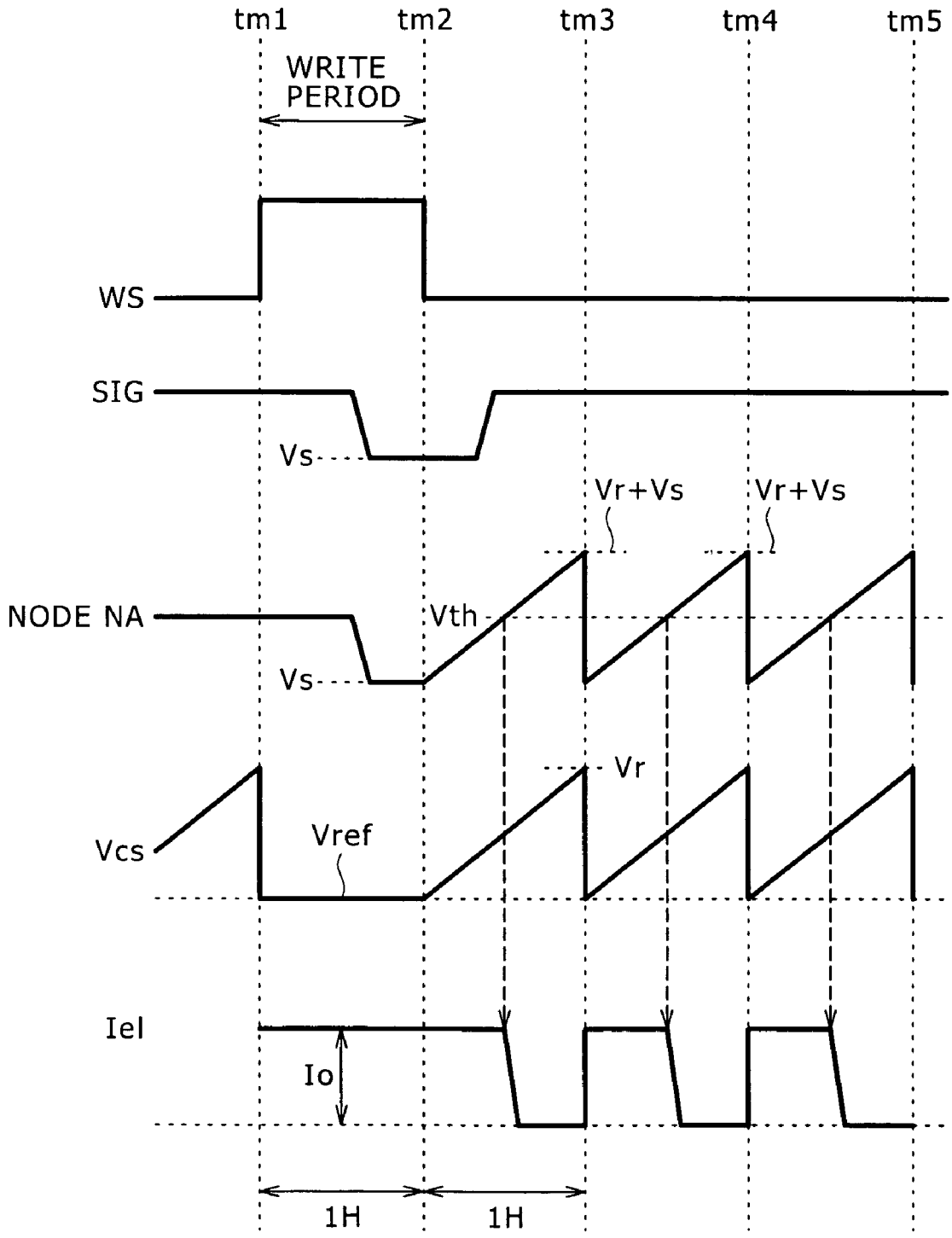
FIG. 10 is an explanatory diagram of the operation of the pixel circuit according to the second embodiment.

The pixel circuit 10 of FIG. 9 is also a circuit formed through a MOS process similarly to the first embodiment. The circuit drives the organic EL device 4 and includes one capacitor Cs and three transistors of an N-channel sampling transistor T1, a P-channel current source transistor T2, and an N-channel drive transistor T3.

The gate of the sampling transistor T1 is coupled to the scan line WS for controlling sampling of a video signal. The drain of the sampling transistor T1 is coupled to the video signal line SIG, and the source thereof is coupled to one end of the capacitor Cs and the gate of the drive transistor T3, i.e. the node NA.

The other end of the capacitor Cs is coupled to the voltage applying line LVcs, and the voltage Vcs is applied to the capacitor Cs by the scan line drive circuit 3 in FIG. 1.

The source of the current source transistor T2 is coupled to a line of the supply voltage Vcc, and the gate thereof is coupled to a line of the bias supply voltage Vb for current adjustment. The drain of the current source transistor T2 is coupled to the drain of the drive transistor T3 and the anode of the organic EL device 4.

The source of the drive transistor T3 is coupled to a line of a fixed potential VIo. The cathode of the organic EL device 4 is coupled to a line of the cathode supply voltage Vk.

The current source transistor T2 is designed to operate in its saturation region, and therefore a constant current Io flows therefrom. The bias potential Vb is set so that the current Io has a current value required in the driven organic EL device 4. For example, if a current of 5 nA is needed to obtain a luminance of 200 nit, the constant current Io is set to 5 nA.

In this circuit, the drive transistor T3 is in parallel with the organic EL device 4. Therefore, during the period when the drive transistor T3 is in the off-state, the constant current Io flows through the organic EL device 4 as a current Iel, which causes the organic EL device 4 to emit light. In contrast, during the period when the drive transistor T3 is in the on-state, the constant current Io flows toward the fixed potential VIo as a current It.

The operation of the circuit will be described with reference to FIG. 10. Initially, at timing tm1, a scan pulse to the scan line WS is switched to a high potential, and thus the N-channel sampling transistor T1 is turned on. Thus, the analog video signal potential Vs is charged in the capacitor Cs through the video signal line SIG, which turns the potential at the node NA to the potential Vs. During the write period of a video signal from the timing tm1 to tm2, that is, during the period when the sampling transistor T1 is in the on-state, the voltage Vcs from the voltage applying line LVcs is fixed at the reference potential Vref (e.g. ground level).

At the timing tm2, the scan line WS is switched to a low potential, which turns off the sampling transistor T1. Simultaneously, the voltage Vcs from the voltage applying line LVcs is switched to a ramp signal voltage of which voltage value increases with time from the reference voltage Vref to the voltage Vr. The cycle of the ramp signal is set sufficiently shorter than one frame period. For example, one horizontal period (1H) is adequate.

In step with the increase of the voltage Vcs, the potential at the node NA rises from the signal potential Vs toward the potential Vs+Vr due to charge holding by the capacitor Cs. In the voltage increase period, when the potential at the node NA reaches the threshold voltage Vth of the drive transistor T3, the drive transistor T3 is turned on. Until the turning on, the constant current Io determined based on the current source transistor T2 and the bias potential Vb flows through the organic EL device 4. The on-resistance of the drive transistor T3 in the on-state is sufficiently smaller than the on-resistance of the organic EL device 4. Therefore, after the drive transistor T3 is turned on, the current Io supplied from the current source transistor T2 flows via the drive transistor T3 into the fixed potential VIo, while almost no current Io flows through the organic EL device 4.

Such operation is implemented not only in the period from the timing tm2 to timing tm3, but also in the period from the timing tm3 to tm4, the period from the timing tm4 to tm5, and so forth. Specifically, after the video signal potential Vs is written in one horizontal period (e.g. tm1-tm2) within one frame, operation similar to that in the period tm2 to tm3 is implemented in each horizontal period subsequent to the write period within one frame period, according to the increase of the voltage Vcs with time as a ramp signal voltage.

The time period Ton during which the drive transistor T3 is in the off-state and therefore a current flows through the organic EL device 4, is expressed by Equation 4.

$$Ton=(Vth/Vr)\cdot Th+(VIo-Vs)/Vr\cdot Th \qquad \text{Equation 4}$$

Note that in Equation 4, Vth denotes the threshold voltage of the drive transistor T3, Vr denotes the ramp signal amplitude, Th denotes the cycle of the ramp signal, VIo denotes the source voltage of the drive transistor T3, and Vs denotes the video signal voltage.

If the voltage Vr, i.e. the ramp signal amplitude is sufficiently large, the time period Ton is almost independent of variation in the threshold voltage Vth of the drive transistor T3.

Specifically, the threshold voltage variation ΔVth of a MOS transistor is about ±10 mV. Therefore, if the ramp signal amplitude Vr is set to a sufficiently large value, e.g. to about 1 V, the threshold voltage variation ΔVth can be suppressed to about 1% of the amplitude Vr, which prevents the ON time period Ton from being greatly affected by the threshold voltage variation ΔVth.

As a result, the brightness Y visually recognized by a human is expressed by the equation Y=Io·Ton. Therefore, gray-scale is controlled based on the ON time period Ton.

Since gray-scale is thus controlled based on the ON time period Ton, if the ramp signal amplitude Vr is set to a large value, gray-scale offset and in-plane display roughness attributed to variation in characteristics of the drive transistor T3 among the pixels can be suppressed. Furthermore, since the cycle of the ramp signal equals to the cycle of one horizontal period, the ramp signal frequency is so high that no flicker arises.

In the pixel circuit 10, the organic EL device 4 is driven with the constant current Io during the emission period thereof. Therefore, similarly to the first embodiment, the deterioration of the organic EL device 4 is smaller than that of a device driven with a constant voltage.

The second embodiment can offer similar advantages to those by the first embodiment. Specifically, the second embodiment also can allow a long-life, high-definition, and high-image-quality organic EL display including a small number of devices.

FIG. 9 illustrates only the pixel circuit 10 as one of the pixel circuits 10R, 10B and 10G. However, also in the second embodiment, the bias voltage Vb is set for each color independently, which allows white balance adjustment and so on, and therefore simplification of external circuitry and facilitation of various adjustments are achieved, similarly to the first embodiment.

Figure 5:
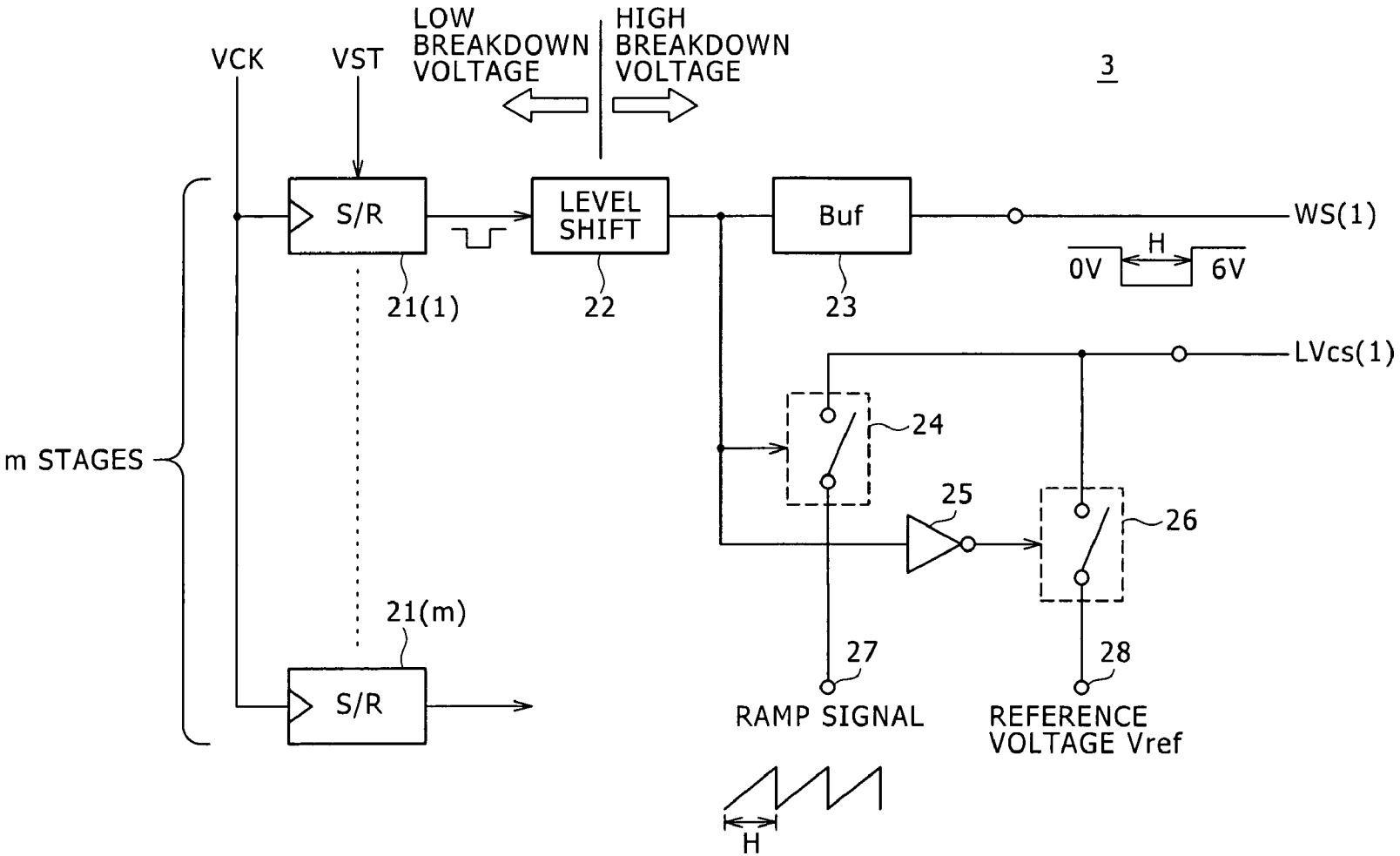
FIG. 5 is a block diagram of a scan line drive circuit according to the first embodiment.

In the second embodiment, the scan line drive circuit 3 is available that has almost the same configuration as that in FIG. 5. However, since the second embodiment includes the N-channel sampling transistor T1, scan pulses supplied to the scan lines WS have polarities opposite to those of the scan pulses in the first embodiment. In addition, the second embodiment has a configuration in which the switch 26 is in the on-state when the scan pulse is at a high potential, while the switch 24 is in the on-state when the scan pulse is at a low potential.

Third Embodiment

Figure 11:
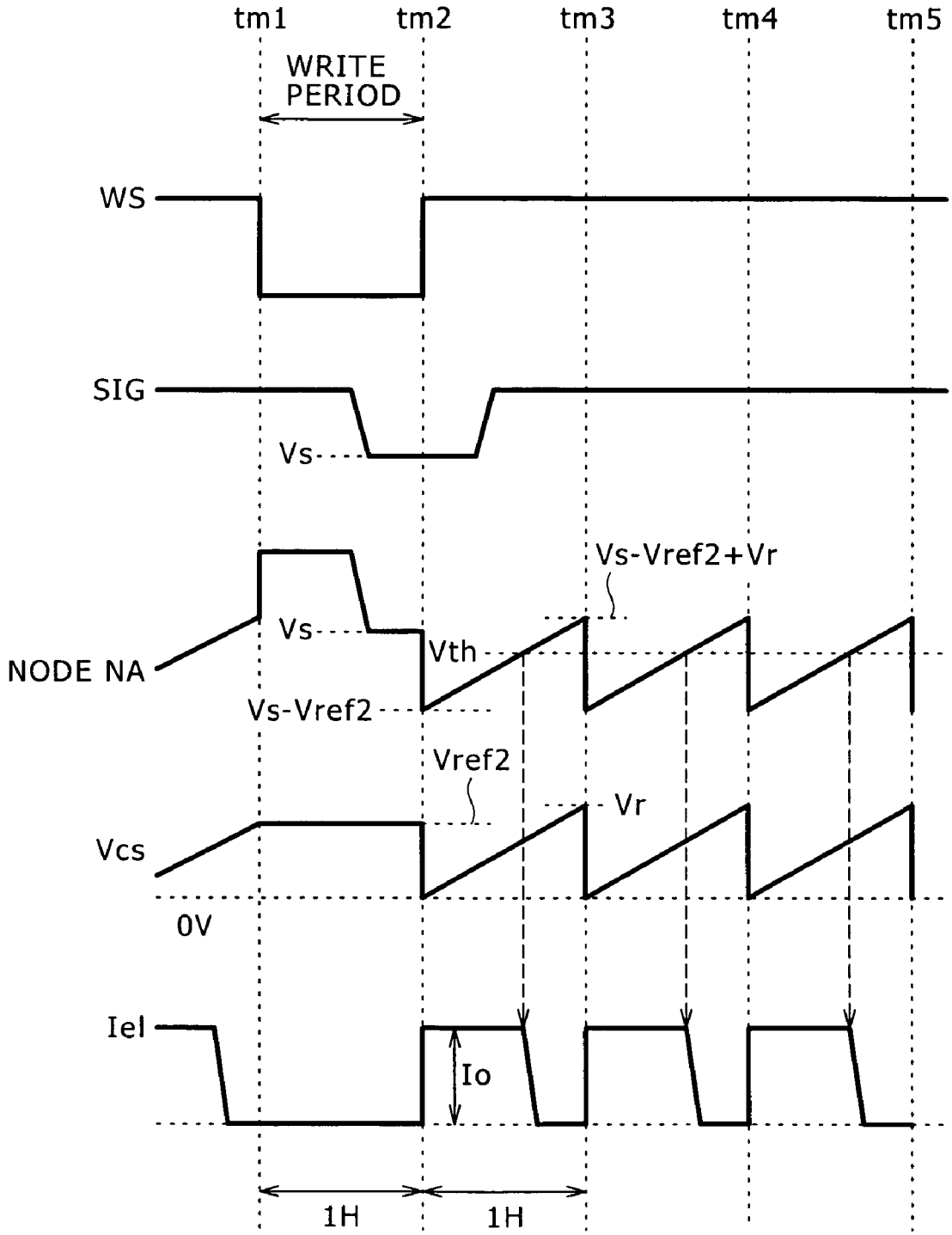
FIG. 11 is an explanatory diagram of the operation of a pixel circuit according to a third embodiment of the invention.

The third embodiment will be described below. The configuration of the pixel circuit 10 according to the third embodiment is the same as that in FIG. 2. However, the drive method therefor is different from that of FIG. 3. FIG. 11 shows the drive method according to the third embodiment.

Initially, at timing tm1, a scan pulse to the scan line WS is switched to a low potential, and thus the P-channel sampling transistor T1 is turned on. Thus, a video signal is charged in the capacitor Cs through the video signal line SIG, which turns the potential at the node NA to the video signal potential Vs. In the write period from the timing tm1 to tm2, during which the sampling transistor T1 is in the on-state and therefore a video signal is sampled, the voltage Vcs supplied from the voltage applying line LVcs is fixed at a certain reference potential Vref2. This reference potential Vref2 is set to a potential higher than the threshold voltage Vth of the drive transistor T3. The video signal written to the capacitor Cs is designed to have such a voltage value that the drive transistor T3 is cut off. Accordingly, during the write period tm1 to tm2 for sampling a video signal, the potential at the node NA is higher than the threshold voltage Vth of the drive transistor T3. Therefore, the drive transistor T3 is kept at the non-conductive state, which applies no current to the organic EL device 4.

At the timing tm2, the scan line WS is switched to a high potential, and therefore the sampling transistor T1 is cut off. Simultaneously, the voltage Vcs from the voltage applying line LVcs is turned from the reference potential Vref2 to 0 V. At this time, the potential at the node NA becomes Vs−Vref2 due to capacitance coupling. Thus, the drive transistor T3 enters the on-state, and therefore the current Io determined by the constant current source transistor T2 flows through the organic EL device 4.

After the timing tm2, the voltage Vcs from the voltage applying line LVcs serves as a ramp signal voltage, and therefore increases with time from 0 V to Vr. The cycle of the ramp signal is set sufficiently shorter than one frame period, e.g. set to be the same as the cycle of one horizontal period.

In step with the increase of the voltage Vcs due to the ramp signal, the potential at the node NA rises from the potential Vs−Vref2 toward the potential Vs−Vref2+Vr due to charge holding by the capacitor Cs. When the potential at the node NA reaches the cut-off potential of the drive transistor T3, the drive transistor T3 is turned off, which stops supply of a current to the organic EL device 4. Until the cut off, that is, during the period when the drive transistor T3 conducts, the constant current Io determined based on the current source transistor T2 and the bias potential Vb flows through the organic EL device 4.

Also in the third embodiment, the time period Ton during which the drive transistor T3 is in the on-state and therefore the organic EL device 4 emits light, is expressed by the equation Ton=(Vth/Vr)·Th+(Vcc−Vs)/Vr·Th, similarly to the first embodiment. When the ramp signal amplitude Vr is sufficiently large, the time period Ton is almost independent of variation in the threshold voltage Vth of the drive transistor T3.

As a result, the brightness Y visually recognized by a human is expressed by the equation Y=Io·Ton. Therefore, gray-scale is controlled based on the ON time period Ton. In addition, the organic EL device 4 is driven with the constant current Io during the emission period thereof. Therefore, EL deterioration of the device is smaller than that of a device driven with a constant voltage.

Furthermore, in the third embodiment, the drive transistor T3 is in the off-state during the period tm1 to tm2 for sampling a video signal. Therefore, pseudo-emission of the organic EL device 4 does not arise in the period. Accordingly, the contrast ratio can be enhanced, which allows a further higher image quality.

In the third embodiment, the reference potential Vref2 is employed as the voltage Vcs from the voltage applying line LVcs in the period tm1 to tm2. It is sufficient in order to achieve this configuration to substitute the reference potential Vref2 for the reference potential Vref input to the terminal 28 of FIG. 5, in the scan line drive circuit 3.

Fourth Embodiment

Figure 12:
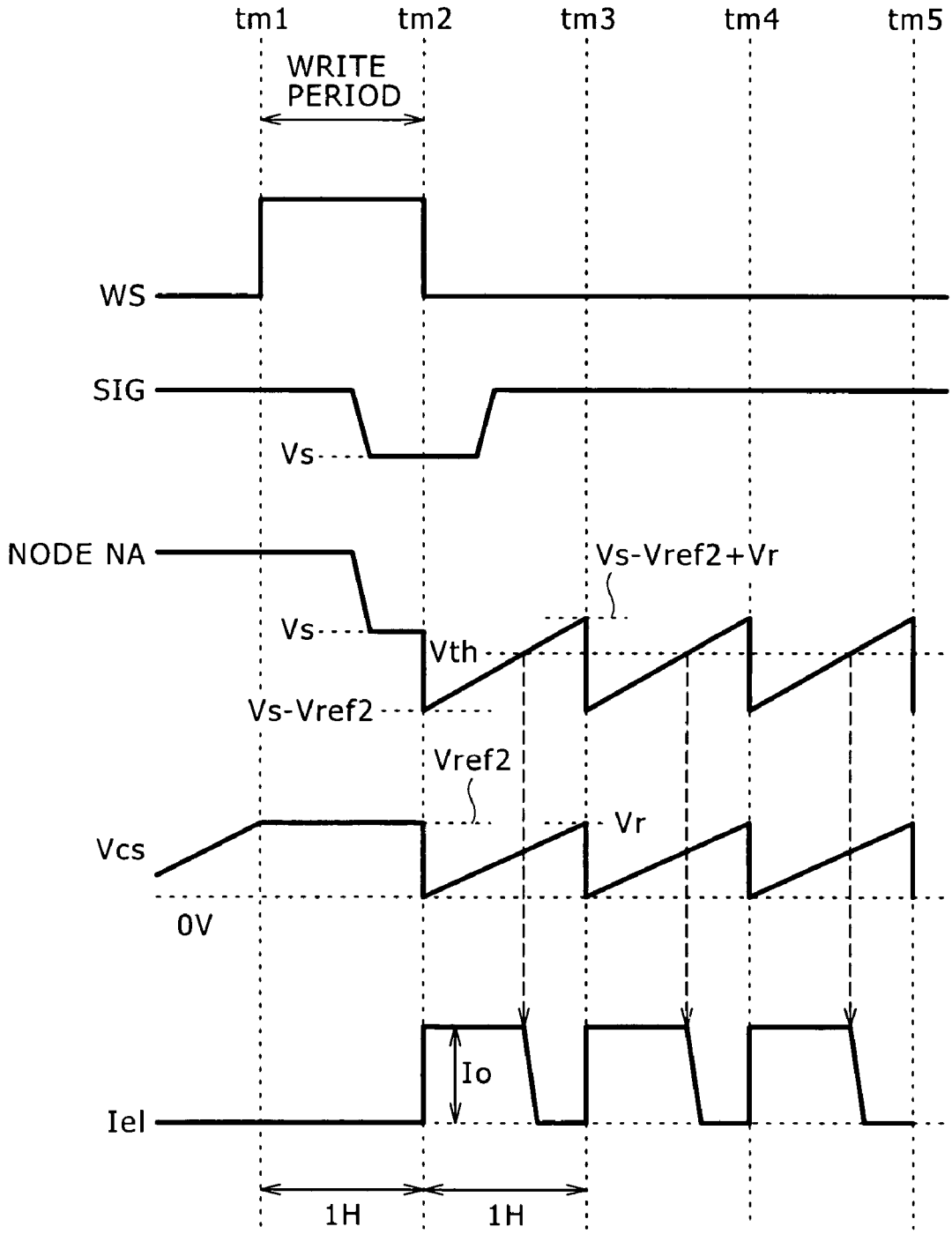
FIG. 12 is an explanatory diagram of the operation of the pixel circuit according to a fourth embodiment of the invention.
Figure 13:
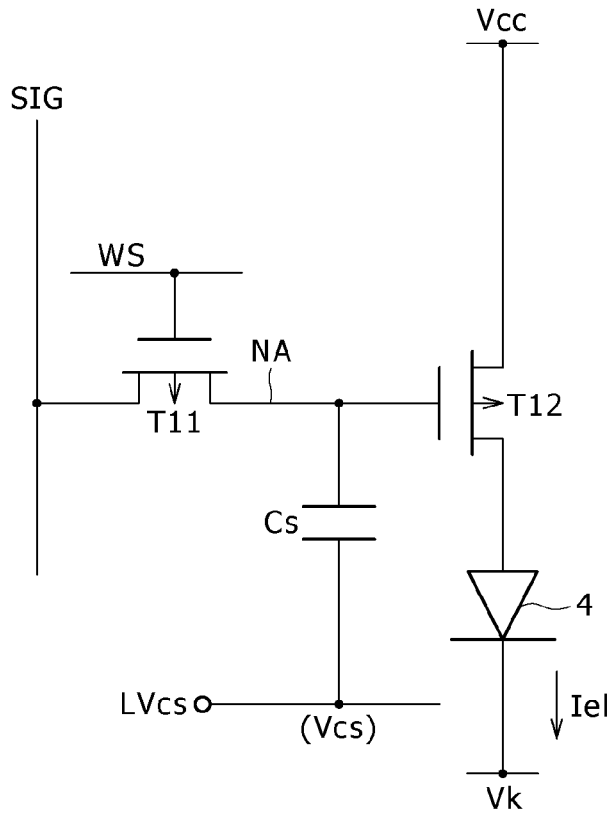
FIG. 13 Prior Art
FIG. 13 is a circuit diagram of a conventional pixel circuit.
Figure 14:
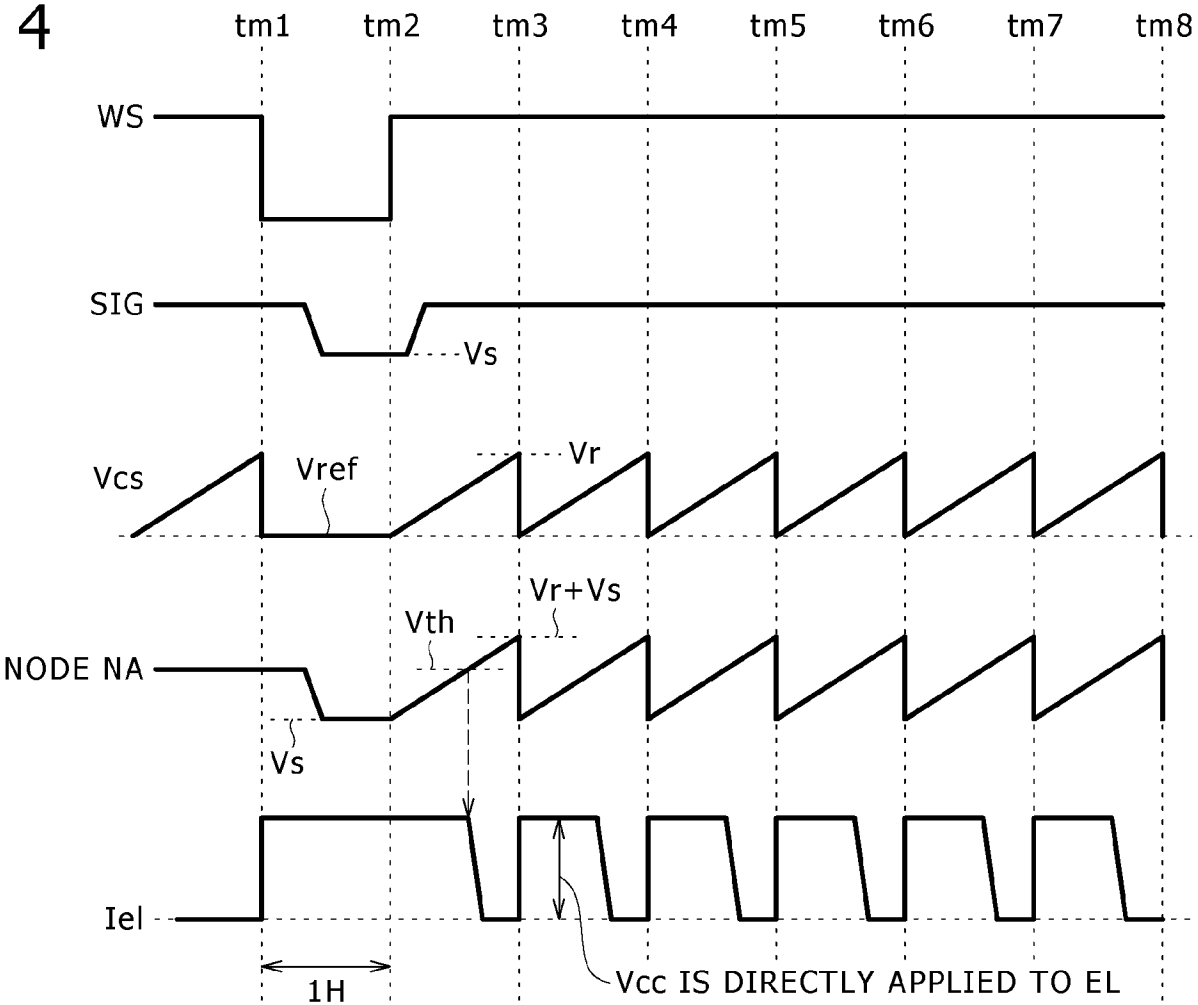
FIG. 14 Prior Art
FIG. 14 is an explanatory diagram of the operation of the conventional pixel circuit.

The fourth embodiment will be described below. The configuration of the pixel circuit 10 according to the fourth embodiment is the same as that in FIG. 9. However, the drive method therefor is different from that of FIG. 10. FIG. 12 shows the drive method according to the fourth embodiment.

Initially, at timing tm1, a scan pulse to the scan line WS is switched to a high potential, and thus the N-channel sampling transistor T1 is turned on. Thus, an analog video signal is charged in the capacitor Cs through the video signal line SIG, which turns the potential at the node NA to the video signal potential Vs.

During the period tm1 to tm2 when the sampling transistor T1 is in the on-state, the voltage Vcs from the voltage applying line LVcs is fixed at the reference potential Vref2. This reference potential Vref2 is set to a potential higher than the threshold voltage Vth of the drive transistor T3. The video signal written to the capacitor Cs is designed to have a voltage value equal to or larger than the threshold voltage of the drive transistor T3. Accordingly, during the write period tm1 to tm2 for sampling a video signal, the potential at the node NA is higher than the threshold voltage Vth of the drive transistor T3. Therefore, the N-channel drive transistor T3 is kept at the conductive state, which applies no current to the organic EL device 4 coupled in parallel with the drive transistor T3.

At the timing tm2, the scan line WS is switched to a low potential, and therefore the sampling transistor T1 is cut off. Simultaneously, the voltage Vcs from the voltage applying line LVcs is turned from the potential Vref2 to 0 V. Thus, the potential at the node NA decreases from Vs to Vs−Vref2 due to capacitance coupling, which turns off the drive transistor T3. Therefore, the constant current Io flows through the organic EL device 4 coupled in parallel with the drive transistor T3, and thus the organic EL device 4 emits light.

After the timing tm2, a ramp signal is used as the voltage Vcs. The voltage of the ramp signal increases with time from 0 to Vr. The cycle of the ramp signal is set sufficiently shorter than one frame period, e.g. set to be the same as the cycle of one horizontal period.

In step with the increase of the voltage Vcs due to the ramp signal, the potential at the node NA rises from the potential Vs−Vref2 toward the potential Vs−Vref2+Vr due to charge holding by the capacitor Cs. When the potential at the node NA reaches the cut-on potential of the drive transistor T3, the drive transistor T3 is turned on. The on-resistance of the drive transistor T3 in the on-state is sufficiently smaller than the on-resistance of the organic EL device 4. Therefore, the current Io supplied from the current source transistor T2 flows via the drive transistor T3 into the fixed potential VIo, while almost no current Io flows through the organic EL device 4. Until the cut on, that is, during the period when the drive transistor T3 is in the off-state, the constant current Io determined based on the current source transistor T2 and the bias potential Vb flows through the organic EL device 4.

The time period Ton during which a current flows through the organic EL device 4 is expressed by the equation Ton=(Vth/Vr)·Th+(VIo−Vs)/Vr·Th, similarly to the second embodiment. If the ramp signal amplitude Vr is sufficiently large, the time period Ton is almost independent of variation in the threshold voltage Vth of the drive transistor T3.

As a result, the brightness Y visually recognized by a human is expressed by the equation Y=Io·Ton. Therefore, gray-scale is controlled based on the ON time period Ton. In addition, the organic EL device 4 is driven with the constant current Io during the emission period thereof. Therefore, EL deterioration of the device is smaller than that of a device driven with a constant voltage. Furthermore, also in the fourth embodiment, pseudo-emission of the organic EL device 4 does not arise during the period tm1-tm2 for sampling a video signal, similarly to the third embodiment. Therefore, the contrast ratio is enhanced, which allows a further higher image quality.

In the fourth embodiment, the scan line drive circuit 3 is available that has almost the same configuration as that in FIG. 5. However, since the fourth embodiment includes the N-channel sampling transistor T1, scan pulses supplied to the scan lines WS have polarities opposite to those of the scan pulses in the first embodiment. In addition, the fourth embodiment has a configuration in which the switch 26 is in the on-state when the scan pulse is at a high potential, while the switch 24 is in the on-state when the scan pulse is at a low potential. Furthermore, similarly to the third embodiment, the reference potential Vref2 may substitute for the reference potential Vref input to the terminal 28 of FIG. 5, in the scan line drive circuit 3.

It should be understood by those skilled in the art that various modifications, combinations, sub-combinations and alterations may occur depending on design requirements and other factors insofar as they are within the scope of the appended claims or the equivalents thereof.

What is claimed is:

1. A display including pixel circuits that are each formed at an intersection between a signal line and a scan line so that the pixel circuits are disposed in a matrix, each of the pixel circuits comprising:

a first transistor of which gate is coupled to the scan line, one of a source and a drain of the first transistor being coupled to the signal line;

a second transistor of which gate is supplied with a bias voltage, one of a source and a drain of the second transistor being coupled to a positive voltage supply;

a third transistor of which gate is coupled to the other of the source and the drain of the first transistor, the third transistor being coupled to the other of the source and the drain of the second transistor;

a capacitor of which one end is coupled to the other of the source and the drain of the first transistor, the other end of the capacitor being supplied with a ramp signal that increases and decreases with time; and an organic electro-luminescence thin film that is driven to emit light by the first, second and third transistors and the capacitor, wherein, the first, second and third transistors and the capacitor are formed by a MOS process, the first transistor conducts in response to a scan pulse supplied from the scan line, and a signal value from the signal line is written to the capacitor when the first transistor conducts, the bias voltage is set so that the second transistor operates as a constant current source during a period when the third transistor is in a conductive state, or during a period when the third transistor is in a non-conductive state, a constant current from the second transistor flows through the organic electro-luminescence thin film so that the organic electro-luminescence thin film emits light, the ramp signal is applied to the other end of the capacitor during a period when the first transistor is in a non-conductive state, as a signal that repeats increase and decrease with a cycle sufficiently shorter than the cycle of one frame, and during a period when the first transistor conducts, a certain reference voltage is applied to the other end of the capacitor.

2. The display according to claim 1, wherein:

one of a source and a drain of the third transistor is coupled to the second transistor, and the other is coupled to an anode electrode of the organic electro-luminescence thin film; and during a period when the third transistor is in a conductive state, a constant current from the second transistor flows through the organic electro-luminescence thin film so that the organic electro-luminescence thin film emits light.

3. The display according to claim 1, wherein:

one of a source and a drain of the third transistor is coupled to a fixed potential, and the other is coupled to the second transistor and an anode electrode of the organic electro-luminescence thin film; and during a period when the third transistor is in a non-conductive state, a constant current from the second transistor flows through the organic electro-luminescence thin film so that the organic electro-luminescence thin film emits light.

4. The display according to claim 1, wherein switching of the third transistor is implemented based on a gate voltage dependent upon the signal value written to the capacitor and the ramp signal.

5. The display according to claim 1, wherein:

one component unit of the pixel circuits is a pixel circuit group including an R pixel circuit, a G pixel circuit and a B pixel circuit, and a plurality of the pixel circuit groups are arranged in a matrix; and the bias voltage includes an R pixel bias voltage, a G pixel bias voltage and a B pixel bias voltage that are separately set for the R pixel circuit, the G pixel circuit, and the B pixel circuit, respectively.

6. A display including pixel circuits that are each formed at an intersection between a signal line and a scan line so that the pixel circuits are disposed in a matrix, each of the pixel circuits comprising:

a first transistor of which gate is coupled to the scan line, one of a source and a drain of the first transistor being coupled to the signal line;

a second transistor of which gate is supplied with a bias voltage, one of a source and a drain of the second transistor being coupled to a positive voltage supply;

a third transistor of which gate is coupled to the other of the source and the drain of the first transistor, the third transistor being coupled to the other of the source and the drain of the second transistor;

a capacitor of which one end is coupled to the other of the source and the drain of the first transistor, the other end of the capacitor being supplied with a ramp signal that increases and decreases with time; and an organic electro-luminescence thin film that is driven to emit light by the first, second and third transistors and the capacitor, wherein, the first, second and third transistors and the capacitor are formed by a MOS process, the first transistor conducts in response to a scan pulse supplied from the scan line, and a signal value from the signal line is written to the capacitor when the first transistor conducts, the bias voltage is set so that the second transistor operates as a constant current source during a period when the third transistor is in a conductive state, or during a period when the third transistor is in a non-conductive state, a constant current from the second transistor flows through the organic electro-luminescence thin film so that the organic electro-luminescence thin film emits light, the ramp signal is applied to the other end of the capacitor during a period when the first transistor is in a non-conductive state, as a signal that repeats increase and decrease with a cycle sufficiently shorter than the cycle of one frame, and during a period when the first transistor conducts, a certain reference voltage that is higher than the threshold voltage of the third transistor is applied to the other end of the capacitor.

7. A method of driving a pixel in a display, the display comprising pixel circuits that are each formed at an intersection between a signal line and a scan line so that the pixel circuits are disposed in a matrix, each of the pixel circuits having a configuration in which an organic electro-luminescence thin film is driven to emit light by first, second and third transistors and a capacitor that are formed by a MOS process, a gate of the first transistor being coupled to the scan line, one of a source and a drain of the first transistor being coupled to the signal line, the other being coupled to one end of the capacitor and a gate of the third transistor, a ramp signal that increases and decreases with time being applied to the other end of the capacitor, a gate of the second transistor being supplied with a bias voltage, one of a source and a drain of the second transistor being coupled to a positive voltage supply, the other being coupled to the third transistor, the method comprising the steps of:

setting the bias voltage so that the second transistor operates as a constant current source;

turning on the first transistor by use of a scan pulse supplied from the scan line, to thereby write a signal value from the signal line to the capacitor; and switching the third transistor based on a gate voltage dependent upon the signal value written to the capacitor and the ramp signal, wherein a constant current from the second transistor flows through the organic electro-luminescence thin film so that the organic electro-luminescence thin film emits light, during a period when the third transistor is in a conductive state, or during a period when the third transistor is in a non-conductive state, wherein the ramp signal is applied to the other end of the capacitor during a period when the first transistor is in a non-conductive state, as a signal that repeats increase and decrease with a cycle sufficiently shorter than the cycle of one frame, and during a period when the first transistor conducts, a certain reference voltage is applied to the other end of the capacitor.

8. The method of driving a pixel according to claim 7, wherein:

one of a source and a drain of the third transistor is coupled to the second transistor, and the other is coupled to an anode electrode of the organic electro-luminescence thin film; and during a period when the third transistor is in a conductive state, a constant current from the second transistor flows through the organic electro-luminescence thin film so that the organic electro-luminescence thin film emits light.

9. The method of driving a pixel according to claim 7, wherein:

one of a source and a drain of the third transistor is coupled to a fixed potential, and the other is coupled to the second transistor and an anode electrode of the organic electro-luminescence thin film; and during a period when the third transistor is in a non-conductive state, a constant current from the second transistor flows through the organic electro-luminescence thin film so that the organic electro-luminescence thin film emits light.

10. A method of driving a pixel in a display, the display comprising pixel circuits that are each formed at an intersection between a signal line and a scan line so that the pixel circuits are disposed in a matrix, each of the pixel circuits having a configuration in which an organic electro-luminescence thin film is driven to emit light by first, second and third transistors and a capacitor that are formed by a MOS process, a gate of the first transistor being coupled to the scan line, one of a source and a drain of the first transistor being coupled to the signal line, the other being coupled to one end of the capacitor and a gate of the third transistor, a ramp signal that increases and decreases with time being applied to the other end of the capacitor, a gate of the second transistor being supplied with a bias voltage, one of a source and a drain of the second transistor being coupled to a positive voltage supply, the other being coupled to the third transistor, the method comprising the steps of:

setting the bias voltage so that the second transistor operates as a constant current source;

turning on the first transistor by use of a scan pulse supplied from the scan line, to thereby write a signal value from the signal line to the capacitor; and switching the third transistor based on a gate voltage dependent upon the signal value written to the capacitor and the ramp signal, wherein a constant current from the second transistor flows through the organic electro-luminescence thin film so that the organic electro-luminescence thin film emits light, during a period when the third transistor is in a conductive state, or during a period when the third transistor is in a non-conductive state wherein, the ramp signal is applied to the other end of the capacitor during a period when the first transistor is in a non-conductive state, as a signal that repeats increase and decrease with a cycle sufficiently shorter than the cycle of one frame, and during a period when the first transistor conducts, a certain reference voltage that is higher than the threshold voltage of the third transistor is applied to the other end of the capacitor.

* * * * *